US006897620B1

(12) United States Patent
Takeuchi et al.

(10) Patent No.: US 6,897,620 B1
(45) Date of Patent: May 24, 2005

(54) ELECTRON EMITTER, DRIVE CIRCUIT OF ELECTRON EMITTER AND METHOD OF DRIVING ELECTRON EMITTER

(75) Inventors: Yukihisa Takeuchi, Nishikamo-Gun (JP); Tsutomu Nanataki, Toyoake (JP); Iwao Ohwada, Nagoya (JP); Nobuyuki Kokune, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/459,415

(22) Filed: Jun. 11, 2003

Related U.S. Application Data

(63) Continuation-in-part of application No. 10/405,897, filed on Apr. 2, 2003.

(30) Foreign Application Priority Data

| | | |
|---|---|---|
| Jun. 24, 2002 | (JP) | 2002-183481 |
| Oct. 1, 2002 | (JP) | 2002-289127 |
| May 30, 2003 | (JP) | 2003-154412 |

(51) Int. Cl.[7] ..... G09G 3/10

(52) U.S. Cl. ..... 315/169.3; 315/169.1; 313/495; 313/509; 345/74.1; 345/212

(58) Field of Search ..... 315/169.3, 169.1, 315/169.4, 169.2; 313/495, 506, 508, 509; 345/74.1, 212

(56) References Cited

U.S. PATENT DOCUMENTS

| | | | | |
|---|---|---|---|---|
| 5,280,221 | A | 1/1994 | Okamoto et al. | 315/169.1 |
| 5,382,867 | A | 1/1995 | Yuji et al. | 313/309 |
| 5,453,661 | A | 9/1995 | Auciello et al. | 315/1 |
| 5,508,590 | A | 4/1996 | Sampayan et al. | 315/169.1 |
| 5,666,019 | A | 9/1997 | Potter | 313/306 |
| 5,726,524 | A | 3/1998 | Debe | 313/309 |
| 5,729,094 | A | 3/1998 | Geis et al. | 315/169.1 |

(Continued)

FOREIGN PATENT DOCUMENTS

| | | |
|---|---|---|
| DE | 3833604 | 4/1990 |
| DE | 10057072 | 5/2001 |
| EP | 0 353 632 | 2/1990 |

(Continued)

OTHER PUBLICATIONS

"Pulsed Electron Source Using a Ferroelectric Cathode," Tokyo Institute of Technology, vol. 68, No. 5, Jan. 7, 1999, pp. 546–550.

Puchkarev, Victor F. and Mesyats, Gennady A., "On the Mechanism of Emission from the Ferroelectric Ceramic Cathode," Journal of Applied Physics, vol. 78, No. 9, Nov. 1, 1995, pp. 5633–5637.

(Continued)

*Primary Examiner*—Don Wong
*Assistant Examiner*—Ephrem Alemu
(74) *Attorney, Agent, or Firm*—Burr & Brown

(57) ABSTRACT

An electron emitter has an emitter section formed on a substrate, a cathode electrode formed on one surface of the emitter section, and an anode electrode formed on the same one surface of the emitter section and cooperating with the cathode electrode in providing a slit. A pulse generation source applies a drive voltage between the cathode electrode and the anode electrode. The anode electrode is connected to GND (ground). The slit has a width in the range from 0.1 $\mu$m to 50 $\mu$m.

36 Claims, 37 Drawing Sheets

U.S. PATENT DOCUMENTS

| | | | | | |
|---|---|---|---|---|---|
| 5,747,926 | A | | 5/1998 | Nakamoto et al. | 313/495 |
| 5,874,802 | A | | 2/1999 | Choi et al. | 313/495 |
| 5,877,594 | A | | 3/1999 | Miyano et al. | 315/169.1 |
| 5,990,605 | A | | 11/1999 | Yoshikawa et al. | 313/310 |
| 6,040,973 | A | * | 3/2000 | Okamoto et al. | 315/169.1 |
| 6,153,978 | A | | 11/2000 | Okamoto | 315/169.3 |
| 6,157,145 | A | | 12/2000 | Vollkommer et al. | 315/339 |
| 6,184,610 | B1 | | 2/2001 | Shibata et al. | 313/309 |
| 6,184,612 | B1 | | 2/2001 | Negishi et al. | 313/310 |
| 6,198,225 | B1 | | 3/2001 | Kano et al. | 315/169.3 |
| 6,274,881 | B1 | | 8/2001 | Akiyama et al. | 313/309 |
| 6,285,123 | B1 | | 9/2001 | Yamada et al. | 313/495 |
| 6,313,815 | B1 | | 11/2001 | Takeda et al. | 345/75.2 |
| 6,359,383 | B1 | | 3/2002 | Chuang et al. | 313/496 |
| 6,452,328 | B1 | | 9/2002 | Saito et al. | 313/495 |
| 6,469,452 | B2 | * | 10/2002 | Seo et al. | 315/169.4 |
| 6,479,924 | B1 | | 11/2002 | Yoo | 313/495 |
| 6,580,108 | B1 | | 6/2003 | Utsumi et al. | 257/288 |
| 2002/0060516 | A1 | | 5/2002 | Kawate et al. | 313/495 |
| 2002/0153827 | A1 | | 10/2002 | Takeuchi et al. | 315/169.3 |

FOREIGN PATENT DOCUMENTS

| | | | |
|---|---|---|---|
| EP | 428853 | | 5/1991 |
| EP | 0 953 958 | A2 | 11/1999 |
| FR | 2639151 | | 5/1990 |
| FR | 2675306 | | 10/1992 |
| FR | 2789221 | | 8/2000 |
| FR | 2789223 | | 8/2000 |
| JP | 46-20944 | | 6/1971 |
| JP | 59-208587 | | 11/1984 |
| JP | 63-150837 | A | 6/1988 |
| JP | 1-311533 | A | 12/1989 |
| JP | 05-325777 | | 12/1993 |
| JP | 7-147131 | A | 6/1995 |
| JP | 08-111166 | | 4/1996 |
| JP | 09-090882 | A | 4/1997 |
| JP | 10-27539 | A | 1/1998 |
| JP | 11-185600 | | 7/1999 |
| JP | 11-288249 | A | 10/1999 |
| JP | 2000-285801 | A | 10/2000 |
| JP | 2000-310970 | A | 11/2000 |
| JP | 3160213 | B2 | 2/2001 |
| JP | 3214256 | | 7/2001 |
| WO | 02/052600 | A1 | 7/2002 |

OTHER PUBLICATIONS

Riege, H., "Electron Emission from Ferroelectrics—a Review," Nucl. Instr. and Meth. A340, 1994, pp. 80–89.

Masatoshi Miyake et al., "*Electron Emission from Ferroelectric Cathodes Excited by Pulsed Voltage*," Tokyo Institute of Technology, vol. 119, No. 5, 1999 pp. 622–627.

U.S. Appl. No. 10/374,955, filed Feb. 25, 2003, Takeuchi et al.

U.S. Appl. No. 10/459,110, filed Jun. 11, 2003, Takeuchi et al.

U.S. Appl. No. 10/459,416, filed Jun. 11, 2003, Takeuchi et al.

U.S. Appl. No. 10/459,386, filed Jun. 11, 2003, Takeuchi et al.

U.S. Appl. No. 10/647,794, filed Aug. 25, 2003, Takeuchi et al.

U.S. Appl. No. 10/673,384, filed Sep. 26, 2003, Takeuchi et al.

U.S. Appl. No. 10/671,763, filed Sep. 26, 2003, Takeuchi et al.

U.S. Appl. No. 10/678,958, filed Oct. 3, 2003, Takeuchi et al.

U.S. Appl. No. 10/699,186, filed Oct. 31, 2003, Takeuchi et al.

U.S. Appl. No. 10/719,521, filed Nov. 21, 2003, Takeuchi et al.

U.S. Appl. No. 10/719,596, filed Nov. 21, 2003, Takeuchi et al.

U.S. Appl. No. 10/730,754, filed Dec. 8, 2003, Takeuchi et al.

U.S. Appl. No. 10/731,901, filed Dec. 9, 2003, Takeuchi et al.

G. Benedek et al., "Electron Emission From Ferroelectric/Antiferroelectric Cathodes Excited by Short High–Voltage Pulses", Journal Applied Physics, vol. 81, No. 3, Feb. 1, 1997, pp. 1396–1403.

Gundel, H. et al., "Low Pressure Hollow Cathode Switch Triggered by a Pulsed Electron Beam Emitted From Ferroelectrics", Applied Physics Letter, American Institute of Physics, New York, US vol. 54, No. 21, May 22, 1989, pp. 2071–2073.

Gundel, H. et al., "Time–Dependent Electron Emission From Ferroelectrics by External Pulsed Electric Fields", Journal of Applied Physics, American Institute of Physics, New York, US vol. 69, No. 2, Jan. 15, 1991, pp. 975–982.

U.S. Appl. No. 10/808,258, filed Mar. 24, 2004, Takeuchi et al.

U.S. Appl. No. 10/919,747, filed Aug. 17, 2004, Takeuchi et al.

U.S. Appl. No. 10/901,932, filed Jul. 29, 2004, Takeuchi et al.

U.S. Appl. No. 10/919,678, filed Aug. 17, 2004, Takeuchi et al.

Kanemaru, Seigou, "Featuring: All About Flat Displays 2000, Leading Technological Trend of FEDs," Electronic Engineering, Nikkan Kogyo Shimbun, Ltd., Jul. 2000, pp. 38–41 (with partial translation).

U.S. Appl. No. 10/951,509, filed Sep. 28, 2004, Takeuchi et al.

U.S. Appl. No. 10/950,976, filed Sep. 27, 2004, Takeuchi et al.

U.S. Appl. No. 10/952,524, filed Sep. 28, 2004, Takeuchi et al.

U.S. Appl. No. 10/951,832, filed Sep. 28, 2004, Takeuchi et al.

* cited by examiner

Va
t0
t2
t3
t1
T1
T2
T1
Va1
Vin
Va2

Ia
0
Pa
(-80mA)

Ik
0
Pk
(-110mA)

Ic
0
Pc
(-30mA)

Vak
50V
Vs
Vap
(-120V)

100C
(100D)

$0 < t1 \leqq 3\tau < t2 \leqq T2$

100E

100F

ELECTRON EMITTER, DRIVE CIRCUIT OF ELECTRON EMITTER AND METHOD OF DRIVING ELECTRON EMITTER

This application is a continuation-in part of Ser. No. 10/405,897 dated Apr. 2, 2003.

BACKGROUND OF THE INVENTION

1. Field of the Invention

The present invention relates to an electron emitter comprising a first electrode and a second electrode formed on an emitter section, and a slit between the first electrode and the second electrode. Further, the present invention relates to a circuit for driving the electron emitter, and a method of driving the electron emitter.

2. Description of the Related Art

Recently, electron emitters having a drive electrode and a common electrode have been used in various applications such as field emission displays (FEDs) and backlight units. In an FED, a plurality of electron emitters are arranged in a two-dimensional array, and a plurality of fluorescent bodies are positioned at predetermined intervals in association with the respective electron emitters.

Conventional electron emitters are disclosed in Japanese laid-open patent publication No. 1-311533, Japanese laid-open patent publication No. 7-147131, Japanese laid-open patent publication No. 2000-285801, Japanese patent publication No. 46-20944, and Japanese patent publication No. 44-26125, for example. All of these disclosed electron emitters are disadvantageous in that since no dielectric body is employed in the emitter section, a forming process or a micromachining process is required between facing electrodes, a high voltage needs to be applied between the electrodes to emit electrons, and a panel fabrication process is complex and entails a high panel fabrication cost.

It has been considered to make an emitter section of a dielectric material. Various theories about the emission of electrons from a dielectric material have been presented in the documents: Yasuoka and Ishii, "Pulsed electron source using a ferroelectric cathode", J. Appl. Phys., Vol. 68, No. 5, p. 546–550 (1999), V. F. Puchkarev, G. A. Mesyats, "On the mechanism of emission from the ferroelectric ceramic cathodes", J. Appl. Phys., Vol. 78, No. 9, 1 Nov., 1995, p. 5633–5637, and H. Riege, "Electron emission ferroelectrics—a reviews", Nucl. Instr. and Meth. A340, p. 80–89 (1994).

In the conventional electron emitters, electrons trapped on the surface of the dielectric material, at the interface between the dielectric material and the upper electrode, and in the dielectric material by the defect level are released (emitted) when polarization reversal occurs in the dielectric material. The number of the electrons emitted by the polarization reversal does not change substantially depending on the voltage level of the applied voltage pulse.

However, the electron emission is not performed stably, and the number of emitted electrons is merely tens of thousands. Therefore, conventional electron emitters are not suitable for practical use. Advantages of an electron emitter having an emitter section made of a dielectric material have not been achieved.

SUMMARY OF THE INVENTION

It is an object of the present invention to provide an electron emitter having an emitter section made of a dielectric material, to provide a circuit for driving the electron emitter, and to provide a method of driving the electron emitter in which a first electrode and a second electrode of the electron emitter are prevented from being damaged due to the emission of electrons, so that the electron emitter has a longer service life and higher reliability.

An electron emitter according to the present invention has an emitter section made of a dielectric material, a first electrode disposed in contact with the emitter section, and a second electrode disposed in contact with the emitter section and cooperating with the first electrode in providing a slit, wherein electrons are emitted from the emitter section by reversing the polarization of at least a portion of the emitter section which is exposed through the slit under a drive voltage applied between the first electrode and the second electrode, the slit having a width ranging from 0.1 $\mu$m to 50 $\mu$m.

Operation of the electron emitter according to the present invention will be described below. When the drive voltage is applied between the first electrode and the second electrode, the polarization of at least the portion of the emitter section which is exposed through the slit is reversed, causing the emitter section to emit electrons from the first electrode which is lower in potential than the second electrode. Specifically, the reversed polarization produces a locally concentrated electric field on the first electrode and the positive poles of dipole moments in the vicinity thereof, emitting primary electrons from the first electrode. The primary electrons emitted from the first electrode impinge upon the emitter section, causing the emitter section to emit secondary electrons.

If the electron emitter has a triple point in which the first electrode, the portion of the emitter section which is exposed through the slit, and a vacuum atmosphere are present, then the primary electrons are emitted from a portion of the first electrode near the triple point, and the secondary electrons are emitted from the emitter section when the primary electrons emitted from the portion of the first electrode impinge upon the emitter section. The secondary electrons referred to herein include in-solid electrons and Auger electrons expelled out of the emitter section and also all primary electrons scattered in the vicinity of the surface of the emitter (reflected electrons). If the thickness of the first electrode is very small (up to 10 nm), then electrons are emitted from the interface between the first electrode and the emitter section.

Since electrons are emitted according to the above principles, the electron emission is stable, and is carried out more than 2,000,000,000 times, making the electron emitter highly practical. As the number of emitted electrons increases substantially in proportion to the level of the drive voltage applied between the first electrode and the second electrode, the number of emitted electrons can easily be controlled.

If the electron emitter is used as a display pixel, for example, then a third electrode is disposed over the emitter section at a position confronting at least the slit, the third electrode being coated with a fluorescent layer. Of the emitted electrons, some are emitted to the third electrode to excite the fluorescent layer, which produces a fluorescent emission directed outwardly. Other electrons are emitted to the second electrode.

The electrons emitted to the second electrode ionize a gas or atoms of the second electrode which are present mainly in the vicinity of the second electrode into positive ions and electrons. Atoms of the second electrode which are present in the vicinity of the second electrode occur as a result of evaporation of part of the second electrode and float in the vicinity of the second electrode. Since electrons produced by the ionization further ionize the gas and the atoms, the electrons are increased exponentially. As exponential increase of the electrons goes on until electrons and positive ions are present neutrally, a local plasma is generated.

When the positive ions produced by the ionization impinge upon the first electrode, the first electrode is damaged.

As described above, when the polarization of at least the portion of the emitter section which is exposed through the slit is reversed, a locally concentrated electric field is generated on the first electrode and the positive poles of dipole moments in the vicinity thereof. If the intensity of the electric field at this electric field concentration point is represented by E, the voltage applied between the first electrode and the second electrode (the voltage appearing between the first electrode and the second electrode when the drive voltage outputted from a drive voltage source is applied between the first electrode and the second electrode) by V, and the width of the slit by d, then the intensity E of the electric field at the electric field concentration point, which is required to be of a value or higher for emitting electrons, is indicated by E=V/d. In order to increase the intensity E of the electric field, the voltage V may be increased or the width d of the slit may be reduced.

If the applied voltage V is increased, then (1) since the withstand voltage of a drive circuit for the electron emitter needs to be increased, the drive circuit cannot be reduced in size and tends to become highly expensive, and (2) because positive ions generated by the plasma gains energy under the voltage V and impinge upon the first electrode, the first electrode is more liable to be damaged.

According to the present invention, the width d of the slit is reduced. The conventional electron emitters for emitting electrons under an electric field require an electric field of about $5\times10^9$ V/m, and need a small slit width of 20 nm if the applied voltage is less than 100 V.

According to the present invention, since the emitter section is made of a dielectric material, if the applied voltage is less than 100 V, then the width d of the slit is not required to be as small as 20 nm, but may be about 20 $\mu$m. Depending on the selected value of the applied voltage, the width d of the slit should preferably be selected in the range from 0.1 $\mu$m to 50 $\mu$m, or more preferably in the range from 0.1 $\mu$m to 10 $\mu$m. If the applied voltage is about 10 V, then the width d of the slit should preferably be selected in the range from 0.1 $\mu$m to 1 $\mu$m.

The width d of the slit should be 0.1 $\mu$m or greater because it makes it easy to form the slit and also keeps the first electrode and the second electrode insulated from each other. The width d of the slit should be 50 $\mu$m or less, 10 $\mu$m or less, or 1 $\mu$m or less because it is effective to lower the electron emission voltage depending on the selected value of the applied voltage. With the width d of the slit selected in the above range, the drive circuit can be reduced in size and cost, and the first electrode can be prevented from being damaged for a longer service life.

According to the present invention, the first electrode and the second electrode may be formed on an upper surface of the emitter section, and the slit may comprise a gap.

The first electrode may be formed in contact with one side surface of the emitter section, and the second electrode may be formed in contact with another side surface of the emitter section. The emitter section may be present in the slit.

If the slit comprises a gap, then the width of the slit increases when the first electrode is damaged, making it difficult to keep the applied voltage low. If the emitter section is present in the slit, then the width of the slit remains unchanged even when the first electrode is damaged. As a result, electrons can be emitted stably under a constant voltage, and the electrodes can have a longer service life.

Furthermore, since the emitter section is interposed between the two electrodes, the emitter section can be polarized completely, emitting electrons stably and efficiently due to the reversed polarization.

If the emitter section is formed in a tortuous pattern, then the area of contact between the first electrode and the emitter section and the area of contact between the second electrode and the emitter section are increased for efficiently emitting electrons.

If the emitter section is disposed on a substrate, the first electrode is disposed in contact with one side surface of the emitter section, the second electrode is disposed in contact with another side surface of the emitter section, and the emitter section is present in the slit, then the electron emitter may further comprise a third electrode disposed over the substrate, the third electrode having an upper surface coated with a fluorescent layer.

Usually, if the electron emitter is constructed as a display pixel, then a plurality of electron emitters are arranged in a matrix, a display panel is disposed in confronting relation to the electron emitters. A spacer is disposed adjacent to the electron emitters.

If a third electrode is formed on the reverse side of the display panel (the surface facing the electron emitters), and the fluorescent layer is formed on the third electrode, then some of the electrons emitted from the electron emitters may impinge upon the spacer, tending to negatively charge the spacer.

When the spacer is negatively charged, the electric field distribution between the electron emitters and the third electrode, i.e., the electric field distribution for directing the electrons emitted from the electron emitters toward the third electrode, is changed to fail to accurately excite the fluorescent layer with an electron beam, resulting in a displayed image quality failure.

The distribution of emitted electrons may be progressively wider toward the third electrode. Such an electron distribution may possibly be disadvantageous in reducing the pitch of pixels (increasing the image resolution). The distribution of emitted electrons may be prevented from being spread by positioning at least one control electrode between the electron emitters and the third electrode. However, the overall assembly would be complex in structure and would be highly costly to manufacture.

According to the present invention, the third electrode is disposed on the upper surface of the substrate, and the upper surface of the third electrode is coated with the fluorescent layer. Therefore, even when the spacer is negatively charged, the electric field distribution for directing the electrons emitted from the electron emitters toward the third electrode is essentially not changed. Therefore, the fluorescent layer can accurately be excited with the electron beam, preventing a displayed image quality failure.

Inasmuch as the electrons are not required to fly to the display panel, there is no need to take into account the spreading of the distribution of emitted electrons. Consequently, the pitch of pixels can be reduced, and hence the image resolution can be increased.

In the above arrangement, some of the electrons emitted from the electron emitters may not be directed toward the third electrode on the substrate, but toward the display panel. Therefore, if a fourth electrode is positioned over the emitter section in confronting relation to the emitter section and a negative voltage is applied to the fourth electrode, then the electrons emitted from the electron emitters can be directed efficiently toward the third electrode for thereby increasing the contribution of the emitted electrons to the excitation of the fluorescent layer.

According to the present invention, there is also provided a drive circuit for energizing an electron emitter comprising an emitter section made of a dielectric material, a first electrode disposed in contact with the emitter section, and a second electrode disposed in contact with the emitter section and cooperating with the first electrode in providing a slit, wherein electrons are emitted from the emitter section by reversing the polarization of at least a portion of the emitter section which is exposed through the slit under a drive voltage applied between the first electrode and the second electrode, the drive circuit comprising a capacitor connected in series to the electron emitter.

For causing the first electrode to emit primary electrons by applying a voltage to the first electrode, it is necessary to apply a sharp voltage change to the first electrode. Usually, the waveform of the voltage applied between the first electrode and the second electrode is of a gradual nature as a whole due to the CR time constant based on the electrostatic capacitance and other resistive component between the first electrode and the second electrode. However, the voltage level that rises or falls steeply is low, and the voltage waveform until the voltage level reaches 95%, for example, of a prescribed voltage (the rising or falling voltage of the source for generating the drive voltage) is gradual. An attempt is made to obtain an apparent steep voltage change over a required voltage level by increasing the amplitude of the drive voltage.

According to the above process, if the electron emitter is regarded as a type of capacitor, then since the voltage (the applied voltage) applied between the first electrode and the second electrode is increased, electrons are emitted by a high-speed charging with a large current. However, a subsequent application of a high voltage causes an excessive current to flow, tending to damage the first electrode owing to the Joule heat generated thereby and positive ions impinging upon the first electrode.

According to the present invention, with the above arrangement, since the electrostatic capacitance of the capacitor is connected in series to the electrostatic capacitance formed by the first electrode and the second electrode, the overall capacitance becomes smaller than the electrostatic capacitance formed by the first electrode and the second electrode, and the CR time constant becomes smaller accordingly. As a result, there is obtained a voltage change going quickly up or down to a voltage level (e.g., 95% of the prescribed voltage) which is required for emitting electrons as the waveform of the applied voltage, so that the electron emission voltage can be lowered. As no high voltage needs to be applied to the electron emitter, it is possible to suppress an excessive current.

According to the present invention, there is also provided a drive circuit for energizing an electron emitter comprising an emitter section made of a dielectric material, a first electrode disposed in contact with the emitter section, and a second electrode disposed in contact with the emitter section and cooperating with the first electrode in providing a slit, wherein electrons are emitted from the emitter section by reversing the polarization of at least a portion of the emitter section which is exposed through the slit under a drive voltage applied between the first electrode and the second electrode, the drive circuit comprising a current-suppressing resistive element connected in series to the electron emitter.

The above arrangement suppresses an excessive current flowing through the electron emitter for thereby reducing damage to the first electrode, etc.

Preferably, current-suppressing resistive element has nonlinear resistance characteristics. For example, the current-suppressing resistive element should preferably comprise a MOSFET device for preventing the voltage applied between the first electrode and the second electrode from changing gradually, but causing the voltage applied between the first electrode and the second electrode to change sharply.

An inductor may be connected in series to the electron emitter. The inductor thus connected is effective to reduce the time required until the voltage between the first electrode and the second electrode becomes a predetermined voltage (coercive voltage if the emitter section is made of a piezoelectric material) from the time when the second voltage starts to be applied. Furthermore, a quick rise or fall time can be achieved without lowering the resistance of the resistive element.

In the drive circuit, a step comprising a preparatory period in which a first voltage of such a level that the first electrode is higher in potential than the second electrode is applied between the first electrode and the second electrode to polarize the emitter section, and an electron emission period in which a second voltage of such a level that the first electrode is lower in potential than the second electrode is applied between the first electrode and the second electrode to polarize the emitter section to emit electrons therefrom, may be repeated.

In the preparatory period, the emitter section which is made of a dielectric material is polarized. In the subsequent electron emission period, the polarization of the emitter section is reversed. The reversed polarization produces a locally concentrated electric field on the first electrode and the positive poles of dipole moments in the vicinity thereof, emitting primary electrons from the first electrode. The primary electrons emitted from the first electrode impinge upon the emitter section, causing the emitter section to emit secondary electrons. According to the present invention, therefore, electrons can efficiently be emitted from the electron emitter.

If the second voltage is greater in absolute value than the first voltage, then electric power consumption due to the application of the first voltage is reduced, and electrode damage is prevented.

The drive circuit may further comprise a switching circuit for switching between a first cycle and a second cycle, the first cycle including at least one step which comprises a preparatory period in which a first voltage of such a level that the first electrode is higher in potential than the second electrode is applied between the first electrode and the second electrode to polarize the emitter section, and an electron emission period in which a second voltage of such a level that the first electrode is lower in potential than the second electrode is applied between the first electrode and the second electrode to polarize the emitter section to emit electrons from the first electrode, the second cycle including at least one step which comprises a preparatory period in which the second voltage is applied between the first electrode and the second electrode to polarize the emitter section, and an electron emission period in which the first voltage is applied between the first electrode and the second electrode to polarize the emitter section to emit electrons from the second electrode.

With the above arrangement, when the electron emitter is driven in the first cycle only, if a plasma is generated, then positive ions generated by the plasma impinge upon the first electrode, causing damage to the first electrode. Therefore, the durability of the electron emitter is determined only by damage to the first electrode. When the electron emitter is driven in the second cycle only, if a plasma is generated, then the durability of the electron emitter is determined only by damage to the second electrode. Therefore, damage can be distributed to both the first electrode and the second electrode simply by switching between the first cycle and the second cycle, so that the electrodes will have a longer service life.

The drive circuit may further comprise a pulse generation circuit for applying a voltage which turns the polarity of the potential of the second electrode into a polarity different from the polarity of the potential of the first electrode, to the second electrode in at least the electron emission period.

If the second electrode is placed under a constant potential and the drive voltage is applied between the first electrode and the second electrode, then the drive voltage has its dynamic range determined by the withstand voltage of a source of the drive voltage.

However, the pulse generation circuit is effective to increase the dynamic range of the drive voltage applied between the first electrode and the second electrode to a withstand voltage which is the sum of the withstand voltage of the source of the drive voltage and the withstand voltage of the pulse generation circuit. Therefore, the source of the drive voltage may comprise a circuit having a withstand voltage which is one half of the usual withstand voltage, so that the drive circuit may be reduced in size and cost.

Preferably, the preparatory period is longer than the electron emission period.

If a time constant determined by an electrostatic capacitance and other resistive component between the first electrode and the second electrode is represented by $\tau$ and the electron emission period by T, then the time constant $\tau$ the electron emission period T satisfy the following relationship:

$$0 \leqq T \leqq 3\tau.$$

Since the electron emission period is the period of a sharp voltage change which contributes to electron emission, a wasteful current supply is eliminated, resulting in a reduction of electric power consumption, and an emission of excessive electrons is suppressed.

The circuit for driving the electron emitter may further comprise a switching element connected in series to the electron emitter, wherein if a time constant determined by an electrostatic capacitance and other resistive component between the first electrode and the second electrode is represented by $\tau$, the electron emission period by T, and an on-time of the switching element by t, then the time constant $\tau$, the electron emission period T, and the on-time t satisfy the following relationship:

$$0 \leqq t \leqq 3\tau \leqq T.$$

In the above arrangement, if an on-time of the switching element for emitting electrons is represented by t1, and a subsequent off-time of the switching element for keeping electrons emitted and suppressing a current flowing into the first electrode by t2, then the time constant $\tau$, the electron emission period $\tau$, the on-time t1, and the off-time t2 satisfy the following relationship:

$$0 \leqq t1 \leqq 3\tau < t2 \leqq \tau.$$

In the on-time t1 of the switching element, a sharp voltage change contributing to electron emission occurs, and in the off-time t2, the electron emission is kept and the current flowing into the first electrode is suppressed. Therefore, a wasteful current supply is eliminated, resulting in a reduction of electric power consumption, and an emission of excessive electrons is suppressed.

The circuit for driving the electron emitter may further comprise at least one parallel circuit connected in series to the electron emitter, the parallel circuit comprising a resistor and a capacitor which are connected parallel to each other, wherein the electron emission period includes an effective electron emission period from the start of application of the second voltage to the time when the voltage between the first electrode and the second electrode reaches a divided level on the capacitor of the amplitude of the drive voltage.

Since the capacitor of the parallel circuit is connected in series to the electrostatic capacitance formed by the first electrode and the second electrode of the electron emitter, the overall capacitance becomes smaller than the electrostatic capacitance formed by the first electrode and the second electrode, and the CR time constant becomes smaller accordingly. As a result, there is obtained a voltage change going quickly up or down to a voltage level which is required for emitting electrons as the applied voltage, so that the electron emission voltage can be lowered.

Inasmuch as the absolute value of the applied voltage is reduced at the same time that the electron emission period is finished, an excessive current is suppressed, reducing damage to the first electrode and the second electrode for a longer service life thereof.

According to the present invention, there is further provided a method of driving an electron emitter comprising an emitter section made of a dielectric material, a first electrode disposed in contact with the emitter section, and a second electrode disposed in contact with the emitter section and cooperating with the first electrode in providing a slit, the method comprising repeating a step which comprises a preparatory period in which a first voltage of such a level that the first electrode is higher in potential than the second electrode is applied between the first electrode and the second electrode to polarize the emitter section, and an electron emission period in which a second voltage of such a level that the first electrode is lower in potential than the second electrode is applied between the first electrode and the second electrode to polarize the emitter section to emit electrons therefrom. The above method can efficiently emit electrons from the electron emitter. In the electron emission period, electrons are emitted from the emitter section near a triple point comprising the first electrode, the portion of the emitter section which is exposed through the slit, and a vacuum atmosphere. Preferably, the absolute value of the second voltage is greater than the absolute value of the first voltage.

Furthermore, switching may be made between a first cycle and a second cycle, the first cycle including at least one step which comprises a preparatory period in which a first voltage of such a level that the first electrode is higher in potential than the second electrode is applied between the first electrode and the second electrode to polarize the emitter section, and an electron emission period in which a second voltage of such a level that the first electrode is lower in potential than the second electrode is applied between the first electrode and the second electrode to polarize the emitter section to emit electrons from the first electrode, the second cycle including at least one step which comprises a preparatory period in which the second voltage is applied between the first electrode and the second electrode to polarize the emitter section, and an electron emission period in which the first voltage is applied between the first electrode and the second electrode to polarize the emitter section to emit electrons from the second electrode. Upon switching between the first cycle and the second cycle, damage can be distributed to both the first electrode and the second electrode, so that the electrodes will have a longer service life.

According to the present invention, a voltage which turns the polarity of the potential of the second electrode into a polarity different from the polarity of the potential of the first electrode may be applied to the second electrode in at least the electron emission period.

Thus, the dynamic range of the applied voltage can be increased, and hence the withstand voltages of the source for generating the drive signal and the source for generating a common potential can be reduced, so that the drive circuit can be made smaller in size and lower in cost.

In the method, the preparatory period should preferably be longer than the electron emission period.

In the method, if a time constant determined by an electrostatic capacitance and other resistive component between the first electrode and the second electrode is represented by $\tau$ and the electron emission period by T, then the time constant $\tau$ and the electron emission period T may satisfy the following relationship:

$$0 \leqq T \leqq 3\tau.$$

Since the electron emission period is the period of a sharp voltage change which contributes to electron emission, a wasteful current supply is eliminated, resulting in a reduction of electric power consumption, and an emission of excessive electrons is suppressed.

In the method, a switching element may be connected in series to the electron emitter, and if a time constant determined by an electrostatic capacitance and other resistive component between the first electrode and the second electrode is represented by $\tau$, the electron emission period by T, and an on-time of the switching element by t, then the time constant $\tau$, the electron emission period T, and the on-time t may satisfy the following relationship:

$$0 \leqq t \leqq 3\tau \leqq T.$$

Furthermore, if an on-time of the switching element for emitting electrons is represented by t1, and a subsequent off-time of the switching element for keeping electrons emitted and suppressing a current flowing into the first electrode by t2, then the time constant $\tau$, the electron emission period T, the on-time t1, and the off-time t2 may satisfy the following relationship:

$$0 \leqq t1 \leqq 3\tau < t2 \leqq T.$$

In the on-time t1 of the switching element, a sharp voltage change contributing to electron emission occurs, and in the off-time t2, the electron emission is kept and the current flowing into the first electrode is suppressed. Therefore, a wasteful current supply is eliminated, resulting in a reduction of electric power consumption, and an emission of excessive electrons is suppressed.

In the method, at least one parallel circuit is connected in series to the electron emitter, the parallel circuit comprising a resistor and a capacitor which are connected parallel to each other, wherein the electron emission period includes an effective electron emission period from the start of application of the second voltage to the time when the voltage between the first electrode and the second electrode reaches a divided level on the capacitor of the amplitude of the drive voltage.

The above and other objects, features, and advantages of the present invention will become more apparent from the following description of preferred embodiments when taken in conjunction with the accompanying drawings.

DESCRIPTION OF THE PREFERRED EMBODIMENTS

Embodiments of an electron emitter, a circuit for driving the electron emitter, and a method of driving the electron emitter according to the present invention will be described below with reference to FIGS. 1 through 37.

Generally, electron emitters can be used in displays, electron beam irradiation apparatus, light sources, alternatives to LEDs, and electronic parts manufacturing apparatus.

Electron beams in an electron beam irradiation apparatus have a high energy and a good absorption capability in comparison with ultraviolet rays in ultraviolet ray irradiation apparatus that are presently in widespread use. Electron emitters are used to solidify insulating films in superposing wafers for semiconductor devices, harden printing inks without irregularities for drying prints, and sterilize medical devices while being kept in packages.

The electron emitters are also used as high-luminance, high-efficiency light sources such as a projector having a high pressure mercury lamp. The electron emitter according to the present embodiment is suitably used as a light source. The light source using the electron emitter according to the present embodiment is compact, has a long service life, has a fast response speed for light emission. The electron emitter does not use any mercury, and the electron emitter is environmentally friendly.

The electron emitters are also used as alternatives to LEDs in indoor lights, automobile lamps, surface light sources for traffic signal devices, chip light sources, and backlight units for traffic signal devices, small-size liquid-crystal display devices for cellular phones.

The electron emitters are also used in apparatus for manufacturing electronic parts, including electron beam sources for film growing apparatus such as electron beam evaporation apparatus, electron sources for generating a plasma (to activate a gas or the like) in plasma CVD apparatus, and electron sources for decomposing gases. The electron emitters are also used as vacuum micro devices such as high speed switching devices operated at a frequency on the order of Tera-Hz, and large current outputting devices. Further, the electron emitter are used suitably as parts of printers, such as light emitting devices for emitting light to a photosensitive drum, and electron sources for charging a dielectric material.

The electron emitters are also used as electronic circuit devices including digital devices such as switches, relays, and diodes, and analog devices such as operational amplifiers. The electron emitters are used for realizing a large current output, and a high amplification ratio.

Figure 1:
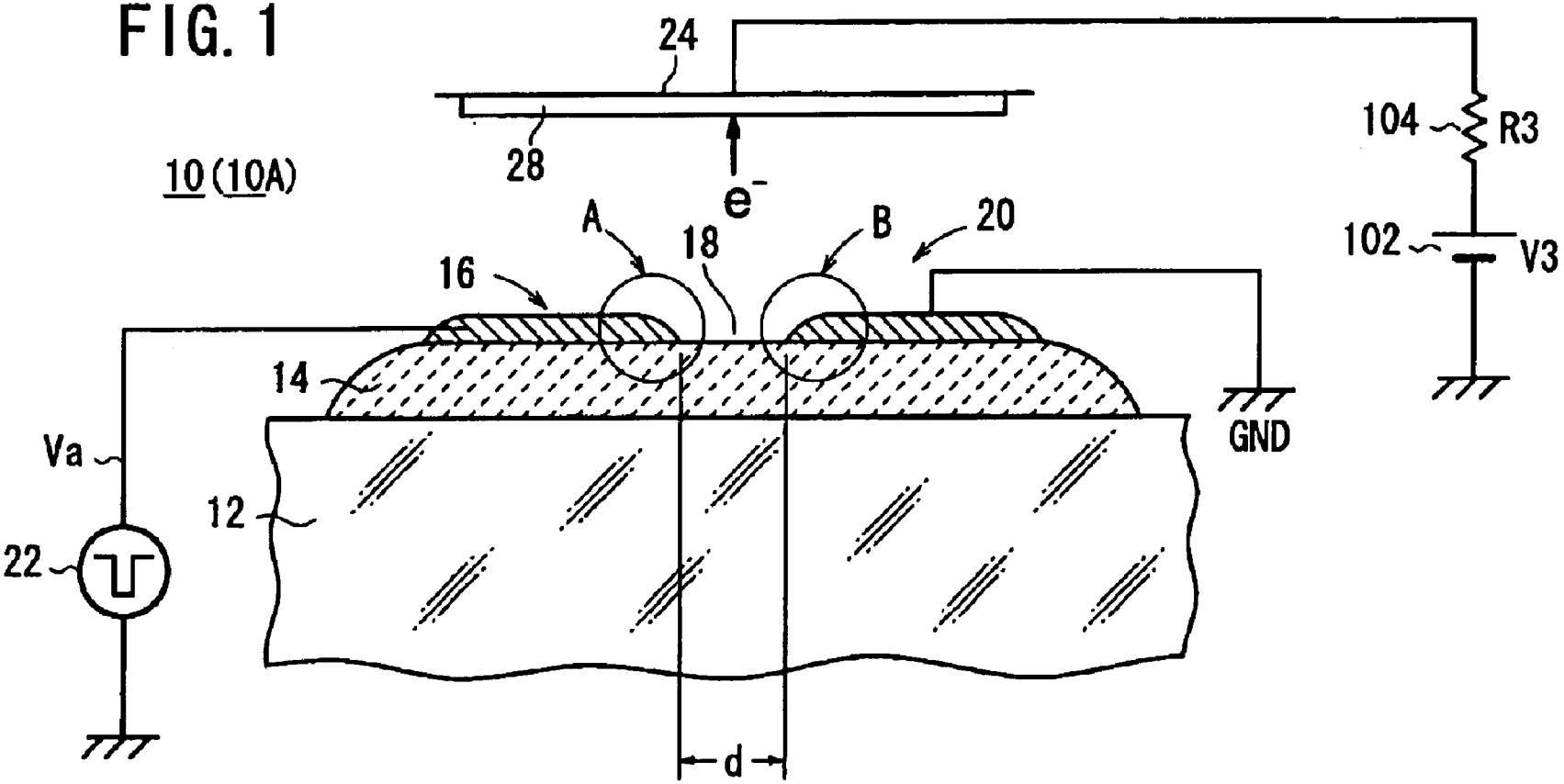
FIG. 1 is a view showing an electron emitter according to an embodiment of the present invention (an electron emitter according to a first specific example)

As shown in FIG. 1, an electron emitter 10 according to the present embodiment comprises an emitter section 14 formed on a substrate 12, a first electrode (cathode electrode) 16 formed on one surface of the emitter section 14, and a second electrode (anode electrode) 20 formed on the same one surface of the emitter section 14 and cooperating with the cathode electrode 16 in providing a slit 18. A pulse generation source 22 applies a drive voltage Va between the cathode electrode 16 and the anode electrode 20. In FIG. 1, the anode electrode 20 is connected to GND (ground) and hence set to a zero potential. However, the anode electrode 20 may be set to a potential other than the zero potential.

For using the electron emitter 10 as a display pixel, a third electrode (collector electrode) 24 is disposed above the emitter section 14 at a position confronting the slit 18. The collector electrode 24 is coated with a fluorescent layer 28. A bias voltage source 102 (having a bias voltage V3) is connected to the collector electrode 24 through a resistor 104 (having a resistance R3).

The electron emitter 10 according to the present embodiment is placed in a vacuum space. As shown in FIG. 1, the electron emitter 10 has electric field concentration points A, B. The point A can also be defined as a triple point where the cathode electrode 16, the emitter section 14, and a vacuum are present at one point. The point B can also be defined as a triple point where the anode electrode 20, the emitter section 14, and a vacuum are present at one point.

The vacuum level in the atmosphere should preferably in the range from $10^2$ to $10^{-6}$ Pa and more preferably in the range from $10^{-3}$ to $10^{-5}$ Pa.

The reason for the above range is that in a lower vacuum, (1) many gas molecules would be present in the space, and a plasma can easily be generated and, if too an intensive plasma were generated, many positive ions thereof would impinge upon the cathode electrode 16 and damage the same, and (2) emitted electrons would tend to impinge upon gas molecules prior to arrival at the collector electrode 24, failing to sufficiently excite the fluorescent layer 28 with electrons that are sufficiently accelerated under the collector potential (bias voltage V3).

In a higher vacuum, though electrons would be liable to be emitted from the electric field concentration points A, B, structural body supports and vacuum seals would be large in size, posing disadvantages on efforts to make the electron emitter smaller in size.

The emitter section 14 is made of a dielectric material. The dielectric material should preferably have a relatively high dielectric constant, e.g., a dielectric constant of 1000 or higher. Dielectric materials of such a nature may be ceramics including barium titanate, lead zirconate, lead magnesium niobate, lead nickel niobate, lead zinc niobate, lead manganese niobate, lead magnesium tantalate, lead nickel tantalate, lead antimony stannate, lead titanate, barium titanate, lead magnesium tungstenate, lead cobalt niobate, etc. or a material whose principal component contains 50 weight % or more of the above compounds, or such ceramics to which there is added an oxide of lanthanum, calcium, strontium, molybdenum, tungsten, barium, niobium, zinc, nickel, manganese, or the like, or a combination of these materials, or any of other compounds.

For example, a two-component material nPMN-mPT (n, m represent molar ratios) of lead magnesium niobate (PMN) and lead titanate (PT) has its Curie point lowered for a larger specific dielectric constant at room temperature if the molar ratio of PMN is increased.

Particularly, a dielectric material where n=0.85 to 1.0 and m=1.0−n is preferable because its specific dielectric constant is 3000 or higher. For example, a dielectric material where n=0.91 and m=0.09 has a specific dielectric constant of 15000 at room temperature, and a dielectric material where n=0.95 and m=0.05 has a specific dielectric constant of 20000 at room temperature.

For increasing the specific dielectric constant of a three-component dielectric material of lead magnesium niobate (PMN), lead titanate (PT), and lead zirconate (PZ), it is preferable to achieve a composition close to a morphotropic phase boundary (MPB) between a tetragonal system and a quasi-cubic system or a tetragonal system and a rhombohedral system, as well as to increase the molar ratio of PMN. For example, a dielectric material where PMN:PT:PZ= 0.375:0.375:0.25 has a specific dielectric constant of 5500, and a dielectric material where PMN:PT:PZ= 0.5:0.375:0.125 has a specific dielectric constant of 4500, which is particularly preferable. Furthermore, it is preferable to increase the dielectric constant by introducing a metal such as platinum into these dielectric materials within a range to keep them insulative. For example, a dielectric material may be mixed with 20 weight % of platinum.

The emitter section 14 may be in the form of a piezoelectric/electrostrictive layer or an anti-ferroelectric layer. If the emitter section 14 comprises a piezoelectric/electrostrictive layer, then it may be made of ceramics such as lead zirconate, lead magnesium niobate, lead nickel niobate, lead zinc niobate, lead manganese niobate, lead magnesium tantalate, lead antimony stannate, lead titanate, barium titanate, lead magnesium tungstenate, lead cobalt niobate, or the like, or a combination of any of these materials.

The emitter section 14 may be made of chief components including 50 weight % or more of any of the above compounds. Of the above ceramics, the ceramics including lead zirconate is most frequently used as a constituent of the piezoelectric/electrostrictive layer of the emitter section 14.

If the piezoelectric/electrostrictive layer is made of ceramics, then lanthanum, calcium, strontium, molybdenum, tungsten, barium, niobium, zinc, nickel, manganese, or the like, or a combination of these materials, or any of other compounds may be added to the ceramics.

For example, the piezoelectric/electrostrictive layer should preferably be made of ceramics including as chief components lead magnesium niobate, lead zirconate, and lead titanate, and also including lanthanum and strontium.

The piezoelectric/electrostrictive layer may be dense or porous. If the piezoelectric/electrostrictive layer is porous, then it should preferably have a porosity of 40% or less.

If the emitter section 14 is in the form of an anti-ferroelectric layer, then the anti-ferroelectric layer may be made of lead zirconate as a chief component, lead zirconate and lead stannate as chief components, lead zirconate with lanthanum oxide added thereto, or lead zirconate and lead stannate as components with lead zirconate and lead niobate added thereto.

The anti-ferroelectric layer may be porous. If the anti-ferroelectric layer is porous, then it should preferably have a porosity of 30% or less.

Strontium bismuthate tantalate is used suitably for the emitter section 14. The emitter section 14 made of strontium bismuthate tantalate is not damaged by the polarization reversal easily. For preventing damages due to the polarization reversal, lamellar ferroelectric compounds represented by a general formula $(BiO_2)^{2+}(A_{m-1}B_mO_{3m+1})^{2-}$ are used. The ionized metal A includes $Ca^{2+}$, $Sr^{2+}$, $Ba^{2+}$, $Pb^{2+}$, $Bi^{2+}$, $La^{2+}$, and the ionized metal B includes $Ti^{4+}$, $Ta^{5+}$, $Nb^{5+}$.

Piezoelectric/electrostrictive/anti-ferroelectric ceramics are mixed with glass components such as lead borosilicate glass or other compounds having a low melting point such as bismuth oxide to lower the firing temperature. Thus, the emitter section 14 is formed easily on the substrate 12.

The emitter section 14 may be made of a material which does not contain any lead, i.e., made of a material having a high melting temperature, or a high evaporation temperature. Thus, the emitter section 14 is not damaged easily when electrons or ions impinge upon the emitter section 14.

The emitter section 14 may be formed on the substrate 12 by any of various thick-film forming processes including screen printing, dipping, coating, electrophoresis, etc., or any of various thin-film forming processes including an ion beam process, sputtering, vacuum evaporation, ion plating, chemical vapor deposition (CVD), plating, etc.

In the present embodiment, the emitter section 14 is formed on the substrate 12 by any of various thick-film forming processes including screen printing, dipping, coating, electrophoresis, etc.

These thick-film forming processes are capable of providing good piezoelectric operating characteristics as the emitter section 14 can be formed using a paste, a slurry, a suspension, an emulsion, a sol, or the like which is chiefly made of piezoelectric ceramic particles having an average particle diameter ranging from 0.01 to 5 $\mu$m, preferably from 0.05 to 3 $\mu$m.

In particular, electrophoresis is capable of forming a film at a high density with high shape accuracy, and has features described in technical documents such as "Electrochemical and industrial physical chemistry, Vol. 53. No. 1 (1985), p. 63–68, written by Kazuo Anzai", and "1st electrophoresis high-degree ceramic forming process research/discussion meeting, collected preprints (1998), p. 5–6, p. 23–24".

The piezoelectric/electrostrictive/anti-ferroelectric material may be formed into a sheet, or laminated sheets. Alternatively, the laminated sheets of the piezoelectric/electrostrictive/anti-ferroelectric material may be laminated on, or attached to another supporting substrate. Any of the above processes may be chosen in view of the required accuracy and reliability.

The cathode electrode 16 is made of materials as described below. The cathode electrode 16 should preferably be made of a conductor having a small sputtering yield and a high evaporation temperature in vacuum. For example, materials having a sputtering yield of 2.0 or less at 600 V in $Ar^+$ and an evaporation pressure of $1.3\times10^{-3}$ Pa at a temperature of 1800 K or higher are preferable. Such materials include platinum, molybdenum, tungsten, etc. The cathode electrode 16 is made of a conductor which is resistant to a high-temperature oxidizing atmosphere, e.g., a metal, an alloy, a mixture of insulative ceramics and a metal, or a mixture of insulative ceramics and an alloy. Preferably, the cathode electrode 16 should be chiefly composed of a precious metal having a high melting point, e.g., platinum, iridium, palladium, rhodium, molybdenum, or the like, or an alloy of silver and palladium, silver and platinum, platinum and palladium, or the like, or a cermet of platinum and ceramics. Further preferably, the cathode electrode 16 should be made of platinum only or a material chiefly composed of a platinum-base alloy. The electrode should preferably be made of carbon or a graphite-base material, e.g., diamond thin film, diamond-like carbon, or carbon nanotube. Ceramics to be added to the electrode material should preferably have a proportion ranging from 5 to 30 volume %.

Further, preferably, organic metal pastes which produce a thin film after firing, such as platinum resinate paste are used. Further, for preventing damages due to polarization reversal, oxide electrode is used. The oxide electrode is made of any of ruthenium oxide, iridium oxide, strontium ruthenate, $La_{1-x}Sr_xCoO_3$ (e.g., x=0.3 or 0.5), $La_{1-x}Ca_xMnO_3$, $La_{1-x}Ca_xMn_{1-y}CO_yO_3$ (e.g., x=0.2, y=0.05). Alternatively, the oxide electrode is made by mixing any of these materials with platinum resinate paste, for example.

The cathode electrode 16 may be made of any of the above materials by an ordinary film forming process which may be any of various thick-film forming processes including screen printing, spray coating, dipping, coating, electrophoresis, etc., or any of various thin-film forming processes including sputtering, an ion beam process, vacuum evaporation, ion plating, CVD, plating, etc. As shown FIG. 2, the cathode electrode 16 has a width W1 of 2 mm and a length L1 of 5 mm. The cathode electrode 16 has a thickness of 20 $\mu$m or less, or preferably 5 $\mu$m or less.

Figure 2:
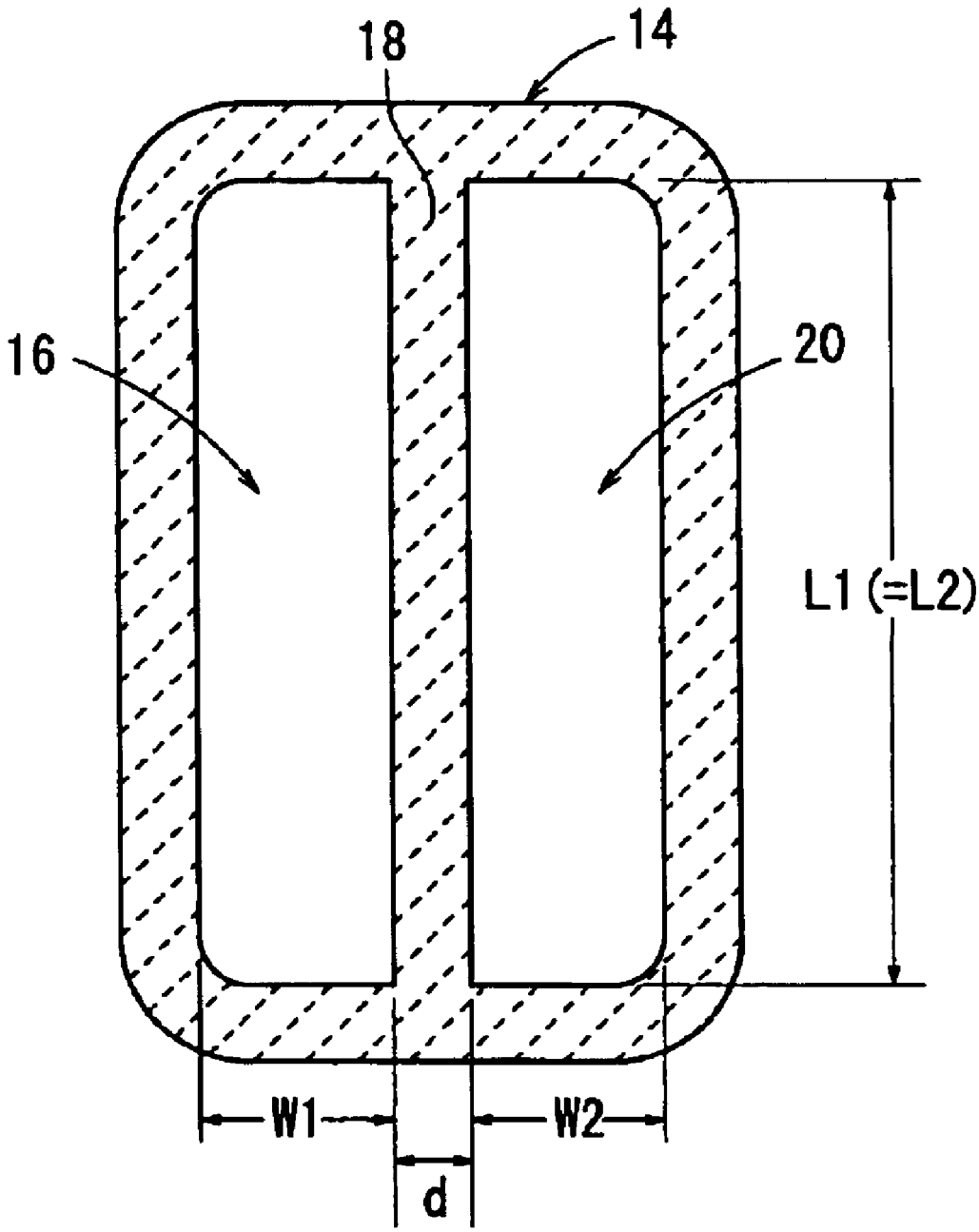
FIG. 2 is a plan view showing electrodes of the electron emitter according to the first specific example.

The anode electrode 20 is made of the same material by the same process as the cathode electrode 16. Preferably, the anode electrode 20 is made by any of the above thick-film forming processes. As shown in FIG. 2, as with the cathode electrode 16, the anode electrode 20 has a width W2 of 2 mm and a length L2 of 5 mm.

The substrate 12 should preferably be made of an electrically insulative material in order to electrically isolate the wire electrically connected to the cathode electrode 16 and the wire electrically connected to the anode electrode 20 from each other.

The substrate 12 may be made of a highly heat-resistant metal or a metal material such as an enameled metal whose surface is coated with a ceramic material such as glass or the like. However, the substrate 12 should preferably be made of ceramics.

Ceramics which the substrate 12 is made of include stabilized zirconium oxide, aluminum oxide, magnesium oxide, titanium oxide, spinel, mullite, aluminum nitride, silicon nitride, glass, or a mixture thereof. Of these ceramics, aluminum oxide or stabilized zirconium oxide is preferable from the standpoint of strength and rigidity. Particularly preferable is stabilized zirconium oxide because its mechanical strength is relatively high, its tenacity is relatively high, and its chemical reaction with the cathode electrode 16 and the anode electrode 20 is relatively small. Stabilized zirconium oxide includes stabilized zirconium oxide and partially stabilized zirconium oxide. Stabilized zirconium oxide does not develop a phase transition as it has a crystalline structure such as a cubic system.

Zirconium oxide develops a phase transition between a monoclinic system and a tetragonal system at about 1000° C. and is liable to suffer cracking upon such a phase transition. Stabilized zirconium oxide contains 1 to 30 mol % of a stabilizer such as calcium oxide, magnesium oxide, yttrium oxide, scandium oxide, ytterbium oxide, cerium oxide, or an oxide of a rare earth metal. For increasing the mechanical strength of the substrate 12, the stabilizer should preferably contain yttrium oxide. The stabilizer should preferably contain 1.5 to 6 mol % of yttrium oxide, or more preferably 2 to 4 mol % of yttrium oxide, and furthermore should preferably contain 0.1 to 5 mol % of aluminum oxide.

The crystalline phase may be a mixed phase of a cubic system and a monoclinic system, a mixed phase of a tetragonal system and a monoclinic system, a mixed phase of a cubic system, a tetragonal system, and a monoclinic system, or the like. The main crystalline phase which is a tetragonal system or a mixed phase of a tetragonal system and a cubic system is optimum from the standpoints of strength, tenacity, and durability.

If the substrate 12 is made of ceramics, then the substrate 12 is made up of a relatively large number of crystalline particles. For increasing the mechanical strength of the substrate 12, the crystalline particles should preferably have an average particle diameter ranging from 0.05 to 2 $\mu$m, or more preferably from 0.1 to 1 $\mu$m.

Each time the emitter section 14, the cathode electrode 16, or the anode electrode 20 is formed, the assembly is heated (sintered) into a structure integral with the substrate 12. After the emitter section 14, the cathode electrode 16, and the anode electrode 20 are formed, they may simultaneously be sintered so that they may simultaneously be integrally coupled to the substrate 12. Depending on the process by which the cathode electrode 16 and the anode electrode 20 are formed, they may not be heated (sintered) so as to be integrally combined with the substrate 12.

The sintering process for integrally combining the substrate 12, the emitter section 14, the cathode electrode 16, and the anode electrode 20 may be carried out at a temperature ranging from 500 to 1400° C., preferably from 1000 to 1400° C. For heating the emitter section 14 which is in the form of a film, the emitter section 14 should be sintered together with its evaporation source while their atmosphere is being controlled.

The emitter section 14 may be covered with an appropriate member for preventing the surface thereof from being directly exposed to the sintering atmosphere when the emitter section 14 is sintered. The covering member should preferably be made of the same material as the substrate 12.

Figure 3:
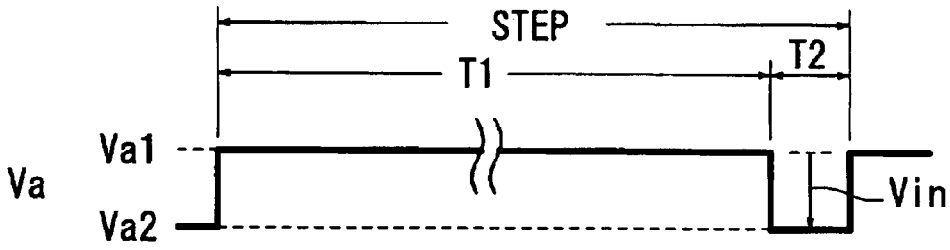
FIG. 3 is a waveform diagram showing a drive signal outputted from a pulse generation source.

The principles of electron emission of the electron emitter 10 will be described below with reference to FIGS. 1 through 6. As shown in FIG. 3, the drive voltage Va outputted from the pulse generation source 22 has repeated steps each including a period in which a first voltage Va1 is outputted (preparatory period T1) and a period in which a second voltage Va2 is outputted (electron emission period T2). The first voltage Va1 is such a voltage that the potential of the cathode electrode 16 is higher than the potential of the anode electrode 20, and the second voltage Va1 is such a voltage that the potential of the cathode electrode 16 is lower than the potential of the anode electrode 20. The amplitude Vin of the drive voltage Va can be defined as the difference (=Va1−Va2) between the first voltage Va1 and the second voltage Va2.

Figure 4:
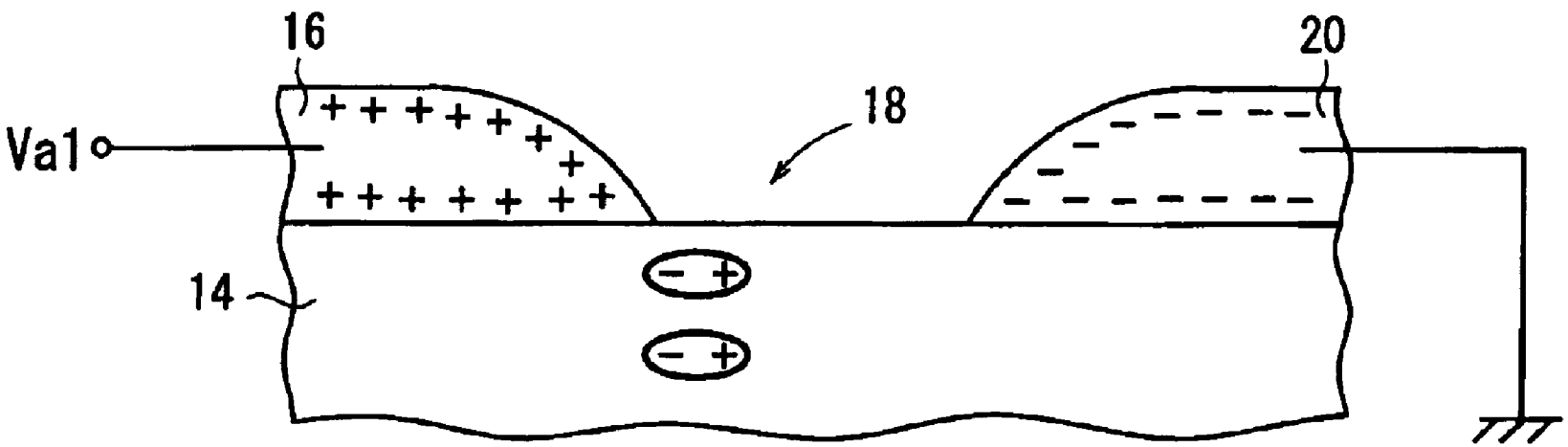
FIG. 4 is a view illustrative of operation when a first voltage is applied to a cathode electrode.

The preparatory period T1 is a period in which the first voltage Va1 is applied between the cathode electrode 16 and the anode electrode 20 to polarize the emitter section 14, as shown in FIG. 4. The first voltage Va1 may be a DC voltage, as shown in FIG. 3, but may be a single pulse voltage or a succession of pulse voltages. The preparatory period T1 should preferably be longer than the electron emission period T2 for sufficient polarization. For example, the preparatory period T1 should preferably be 100 $\mu$sec, or longer. This is because the absolute value of the first voltage Va1 for polarizing the emitter section 14 is smaller than the absolute value of the second voltage Va2.

Figure 5A:
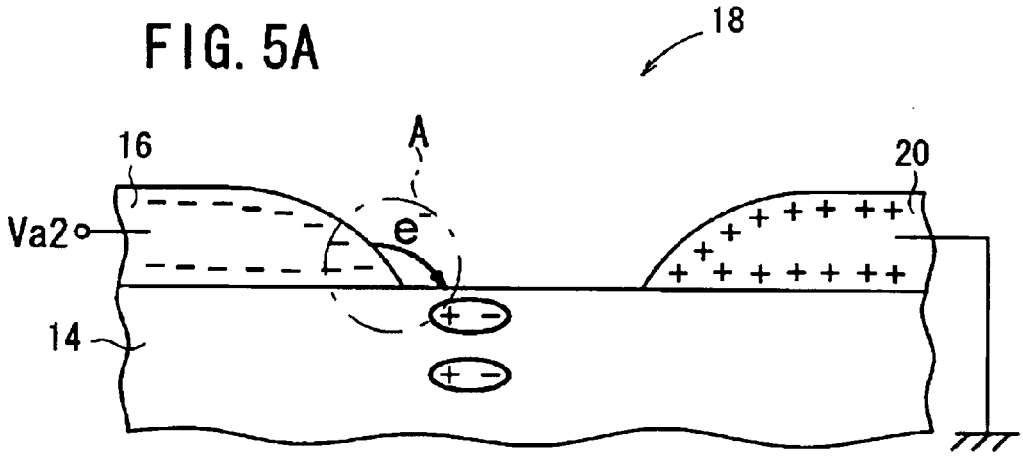
FIG. 5A is a diagram illustrative of the manner in which primary electrons are emitted when a second voltage is applied between a cathode electrode and an anode electrode.
Figure 5B:
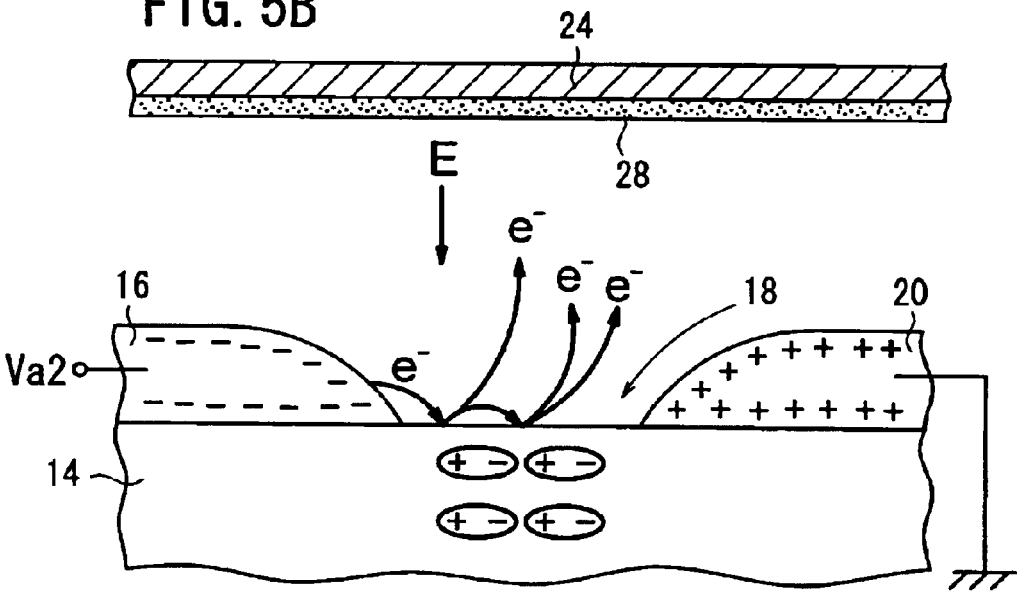
FIG. 5B is a diagram illustrative of the principles of emission of secondary electrons based on emitted primary electrons.

The electron emission period T2 is a period in which the second voltage Va2 is applied between the cathode electrode 16 and the anode electrode 20. When the second voltage Va2 is applied between the cathode electrode 16 and the anode electrode 20, as shown in FIG. 5A, the polarization of at least the portion of the emitter section 14 which is exposed through the slit 18 is reversed. Because of the reversed polarization, a locally concentrated electric field is generated on the cathode electrode 16 and the positive poles of dipole moments in the vicinity thereof, emitting primary electrons from the cathode electrode 16. As shown in FIG. 5B, the primary electrons emitted from the cathode electrode 16 impinge upon the emitter section 14, causing the emitter section 14 to emit secondary electrons.

With the electron emitter 10 having the triple point A where the cathode electrode 16, the emitter section 14, and the vacuum are present at one point, primary electrons are emitted from the cathode electrode 16 near the triple point A, and the primary electrons thus emitted from the triple point A impinge upon the emitter section 14, causing the emitter section 14 to emit secondary electrons. If the thickness of the cathode electrode 16 is very small (up to 10 nm), then electrons are emitted from the interface between the cathode electrode 16 and the emitter section 14.

Since electrons are emitted according to the above principles, the electron emission is stable, and is carried out more than 2 billion times, making the electron emitter 10 highly practical. As the number of emitted electrons increases substantially in proportion to the amplitude Vin of the drive voltage Va applied between the cathode electrode 16 and the anode electrode 20, the number of emitted electrons can easily be controlled.

Of the emitted secondary electrons, some are emitted to the collector electrode 24 (see FIG. 1) to excite the fluorescent layer 28, which produces a fluorescent emission directed outwardly. Other secondary electrons and the primary electrons are emitted to the anode electrode 20.

Figure 6:
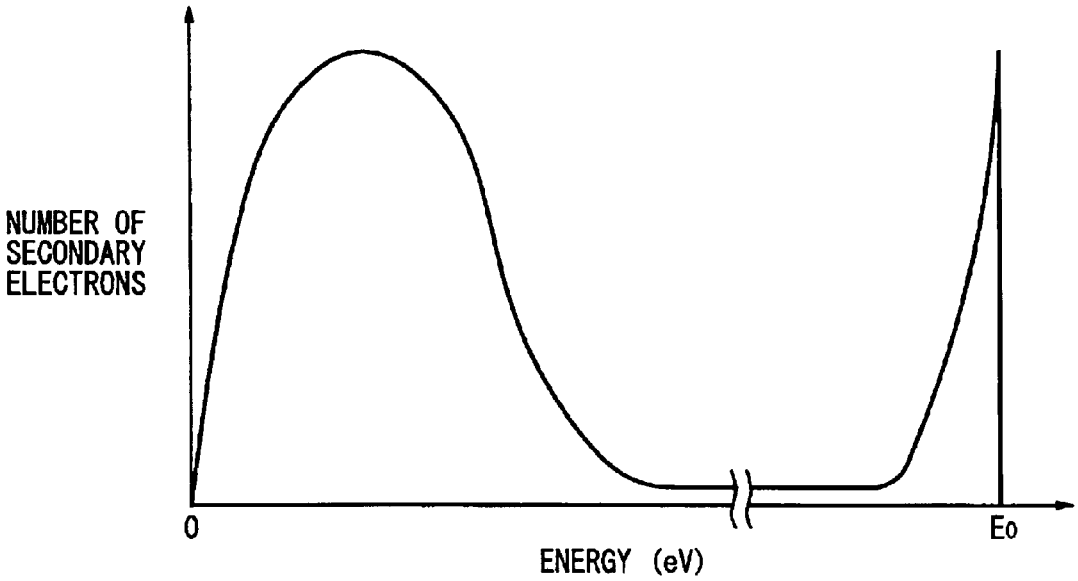
FIG. 6 is a diagram showing the relationship between the energy of emitted secondary electrons and the number of emitted secondary electrons.

A distribution of emitted secondary electrons will be described below. As shown in FIG. 6, most of the secondary electrons have an energy level near zero. When the secondary electrons are emitted from the surface of the emitter section 14 into the vacuum, they move according to only an ambient electric field distribution. Specifically, the secondary electrons are accelerated from an initial speed of about 0 (m/sec) according to the ambient electric field distribution. Therefore, as shown in FIG. 5B, if an electric field E is generated between the emitter section 14 and the collector electrode 24, the secondary electrons have their emission path determined along the electric field E. Therefore, the electron emitter 10 can serve as a highly straight electron source. The secondary electrons which have a low initial speed are in-solid electrons which are expelled out of the emitter section 14 under an energy that has been obtained by a coulomb collision with primary electrons.

The emission path of the secondary electrons can easily be controlled and the diameter of the electron beam can easily be converged, increased, or modified by establishing an electric field distribution between the emitter section 14 and the collector electrode 24 as desired by changing the pattern shape and potential of the collector electrode 24 or positioning a non-illustrated control electrode between the emitter section 14 and the collector electrode 24.

The highly straight electron source and the easy control of the emission path of the secondary electrons provide advantages in reducing the pitch of pixels if the electron emitter 10 according to the present embodiment is constructed as a display pixel.

As can be seen from FIG. 6, secondary electrons having an energy level which corresponds to the energy $E_0$ of primary electrons are emitted. These secondary electrons are primary electrons that are emitted from the cathode electrode 16 and scattered in the vicinity of the surface of the emitter section 14 (reflected electrons).

If the thickness of the cathode electrode 16 is greater than 10 nm, then almost all of the reflected electrons are directed toward the anode electrode 20. The secondary electrons referred to in the present description are defined as including both the reflected electrons and Auger electrons.

If the thickness of the cathode electrode 16 is very small (up to 10 nm), then primary electrons emitted from the cathode electrode 16 are reflected by the interface between the cathode electrode 16 and the emitter section 14, and directed toward the collector electrode 24.

As shown in FIG. 5A, the electrons emitted to the anode electrode 20 ionize a gas or atoms of the anode electrode 20 which are present mainly in the vicinity of the anode electrode 20 into positive ions and electrons. Atoms of the anode electrode 20 which are present in the vicinity of the anode electrode 20 occur as a result of evaporation of part of the anode electrode 20 and float in the vicinity of the anode electrode 20. Since electrons produced by the ionization further ionize the gas and the atoms, the electrons are increased exponentially. As exponential increase of the electrons goes on until electrons and positive ions are present neutrally, a local plasma is generated.

When the positive ions produced by the ionization impinge upon the cathode electrode 16, the cathode electrode 16 is damaged.

If the cathode electrode is of a conventional conical shape, then the tip of the electrode would be deformed into a round shape due to damage, requiring an increased electron emission voltage. One solution would be to make the electrode of a material having a high melting point such as molybdenum or the like, but the electrode itself would become highly expensive, resulting in an increase in the cost required to manufacture the electron emitter. According to another solution, a separate gate electrode or the like would be provided to prevent positive ions from concentrating and impinging upon the cathode electrode 16. This approach would be problematic in that the electrode structure would be complicated and the cost required to manufacture the electron emitter would tend to become high.

According to the present embodiment, various specific examples described below are employed to reduce the size and cost of the electron emitter, lower the electron emission voltage, and minimize damage to the cathode electrode 16 (and the anode electrode 20) for a longer service life thereof.

In an electron emitter 10A according to a first specific example, as shown in FIG. 2, the width d of the slit 18 between the cathode electrode 16 and the anode electrode 20 is reduced to lower the electron emission voltage.

If the intensity of the electric field at the electric field concentration point A is represented by E, the voltage applied between the cathode electrode 16 and the anode electrode 20 (the voltage appearing between the cathode electrode 16 and the anode electrode 20 when the drive voltage Va outputted from the pulse generation source 22 is applied between the cathode electrode 16 and the anode electrode 20) by Vak, and the width of the slit 18 by d, then the intensity E of the electric field at the electric field concentration point A, which is required to be of a value or higher for emitting electrons, is indicated by E=Vak/d. In order to increase the intensity E of the electric field, the voltage Vak may be increased or the width d of the slit 18 may be reduced.

If the voltage Vak is increased, then (1) since the withstand voltage of a drive circuit for the electron emitter needs to be increased, the drive circuit cannot be reduced in size and tends to become highly expensive, and (2) because positive ions generated by the plasma gains energy under the voltage Vak and impinge upon the cathode electrode 16, the cathode electrode 16 is more liable to be damaged.

According to the first specific example, therefore, the width d of the slit 18 is reduced. The conventional electron emitters for emitting electrons under an electric field require an electric field of about $5\times10^9$ V/m, and need a small slit width of 20 nm if the voltage Vak is less than 100 V.

According to the first specific example, since the emitter section 14 is made of a dielectric material, if the voltage Vak is less than 100 V, then the width d of the slit 18 is not required to be as small as 20 nm, but may be about 20 $\mu$m. Depending on the selected value of the voltage Vak, the width d of the slit 18 should preferably be selected in the range from 0.1 $\mu$m to 50 $\mu$m, or more preferably in the range from 0.1 $\mu$m to 10 $\mu$m. If the voltage Vak is about 10 V, then the width d of the slit 18 should preferably be selected in the range from 0.1 $\mu$m to 1 $\mu$m.

The width d of the slit 18 should be 0.1 $\mu$m or greater because it makes it easy to form the slit 18 and also keeps the cathode electrode 16 and the anode electrode 20 insulated from each other. The width d of the slit 18 should be 50 $\mu$m or less, 10 $\mu$m or less, or 1 $\mu$m or less because it is effective to lower the electron emission voltage depending on the selected value of the voltage Vak. With the width d of the slit 18 selected in the above range, the drive circuit can be reduced in size and cost, and the cathode electrode 16 can be prevented from being damaged for a longer service life.

An electron emitter 10B according to a second specific example will be described below with reference to FIGS. 7 through 9.

With the electron emitter 10A according to the first specific example, as shown in FIG. 2, the cathode electrode 16 and the anode electrode 20 are formed on one surface of the emitter section 14, with the slit 18 being defined as a gap.

As damage to the cathode electrode 16 of the electron emitter 10A progresses significantly, the width d of the slit 18 gradually increases. According to the above equation E=Vak/d, in order to obtain a certain electric field intensity, it is necessary to increase the amplitude Vin of the drive voltage Va for electron emission as the width d of the slit 18 increases.

Figure 7:
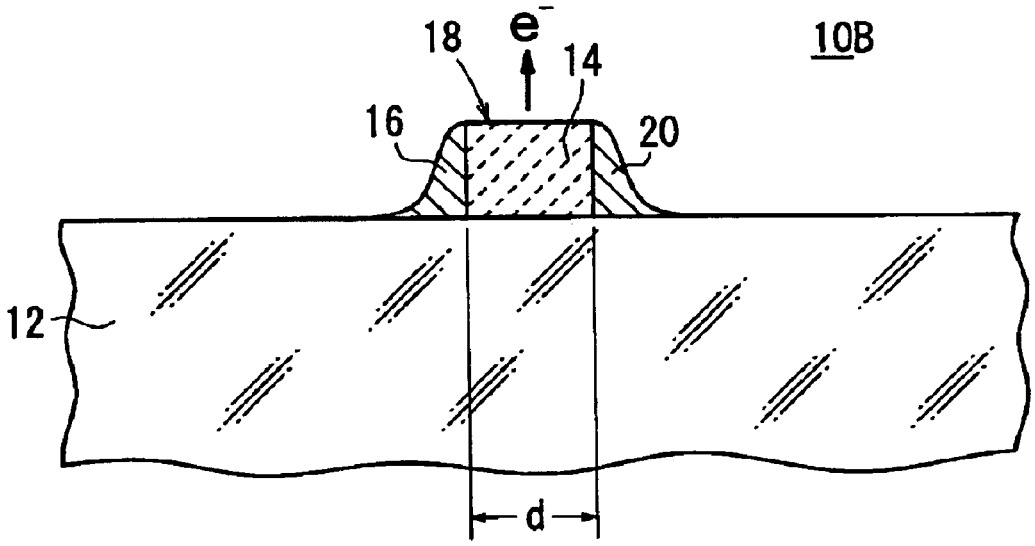
FIG. 7 is a view showing essential parts of an electron emitter according to a second specific example.

As shown in FIG. 7, the electron emitter 10B according to the second specific example has an emitter section 14 formed on the substrate 12, the emitter section 14 having a width d in the range from 0.1 to 50 $\mu$m, a cathode electrode 16 formed on one side surface of the emitter section 14, and an anode electrode 20 formed on the other side surface of the emitter section 14. Thus, the emitter section 14 is present in the slit 18 between the cathode electrode 16 and the anode electrode 20, and is sandwiched between the cathode electrode 16 and the anode electrode 20.

Figure 8:
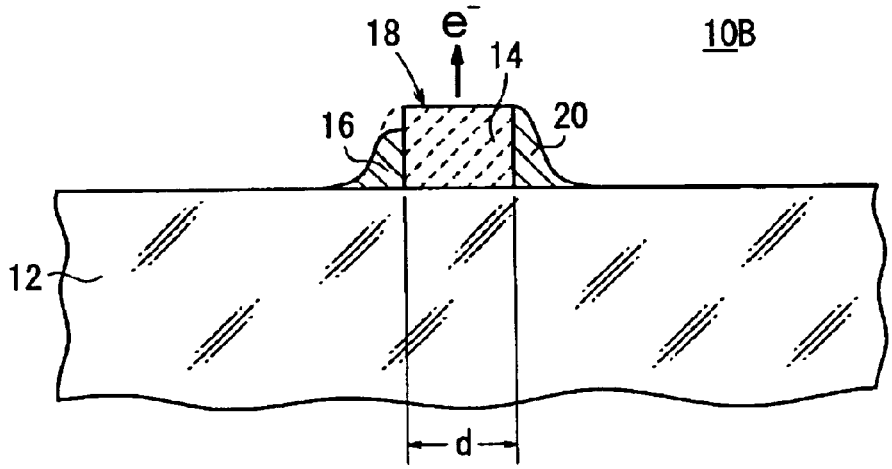
FIG. 8 is a view of the electron emitter according to the second specific example, showing a cathode electrode which is partly damaged.

As shown in FIG. 8, the electron emitter 10B according to the second specific example is capable of emitting electrons stably under a constant voltage even if the cathode electrode 16 is damaged because the distance between the cathode electrode 16 and the anode electrode 20, i.e., the width d of the slit 18, remains unchanged. As a result, the applied voltage Va may be lowered, and the cathode electrode 16 may have a longer service life.

Figure 9:
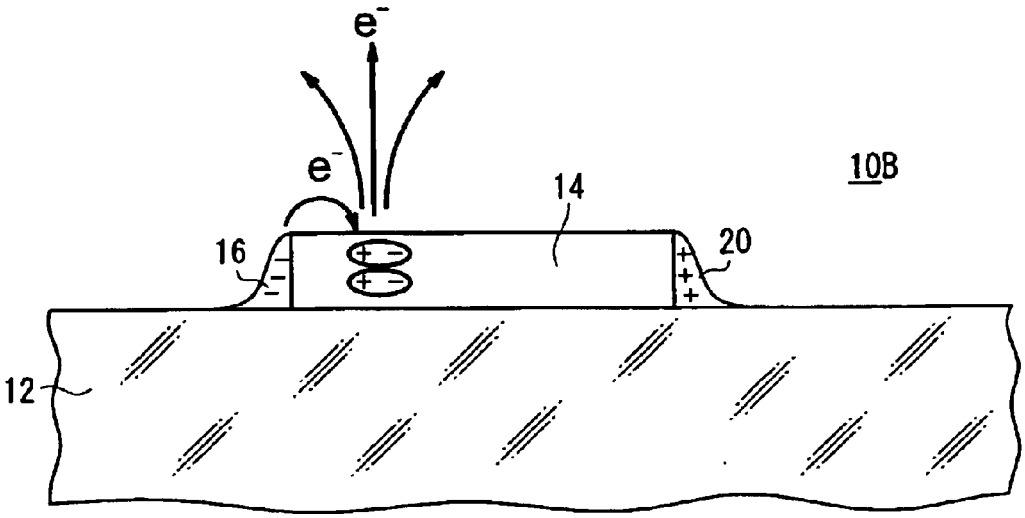
FIG. 9 is a diagram illustrative of the principles of emission of electrons from the electron emitter according to the second specific example.

Inasmuch as the emitter section 14 made of dielectric material is sandwiched between the cathode electrode 16 and the anode electrode 20, as shown in FIG. 9, the emitter section 14 can be polarized completely, emitting electrons stably and efficiently due to the reversed polarization.

An electron emitter 10B according to a second specific example, which is constructed as a display pixel, will be described below with reference to FIGS. 10 and 11.

A plurality of electron emitters 10B are arranged in a matrix on a substrate 12, and a display panel 190 is disposed in confronting relation to the electron emitters 10B. A spacer 192 is disposed adjacent to the electron emitters 10B.

A collector electrode 24 is formed on the reverse side of the display panel 190 (the surface facing the electron emitters 10B), and the fluorescent layer 28 is formed on the collector electrode 24. The electron emitters 10B can now function as display pixels when electrons are emitted from the electron emitters 10B.

Figure 10:
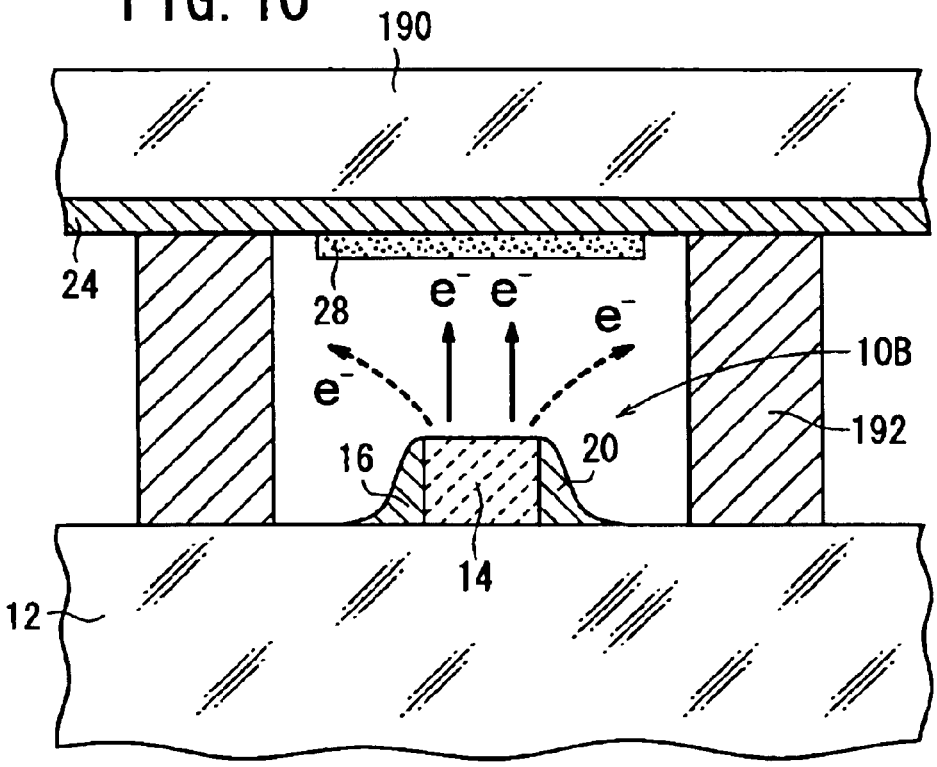
FIG. 10 is a view showing display pixels constructed of the electron emitters according to the second specific example.

In the arrangement shown in FIG. 10, some of the electrons emitted from the electron emitters 10B may impinge upon the spacer 192, tending to negatively charge the spacer 192.

When the spacer 192 is negatively charged, the electric field distribution between the electron emitters 10B and the collector electrode 24, i.e., the electric field distribution for directing the electrons emitted from the electron emitters 10B toward the collector electrode 24, is changed to fail to accurately excite the fluorescent layer 28 with the electron beam, resulting in a displayed image quality failure.

The distribution of emitted electrons may be progressively wider toward the collector electrode 24. Such an electron distribution may possibly be disadvantageous in reducing the pitch of pixels (increasing the image resolution). The distribution of emitted electrons may be prevented from being spread by positioning at least one control electrode between the electron emitters 10B and the collector electrode 24. However, the overall assembly would be complex in structure and would be highly costly to manufacture.

Figure 11:
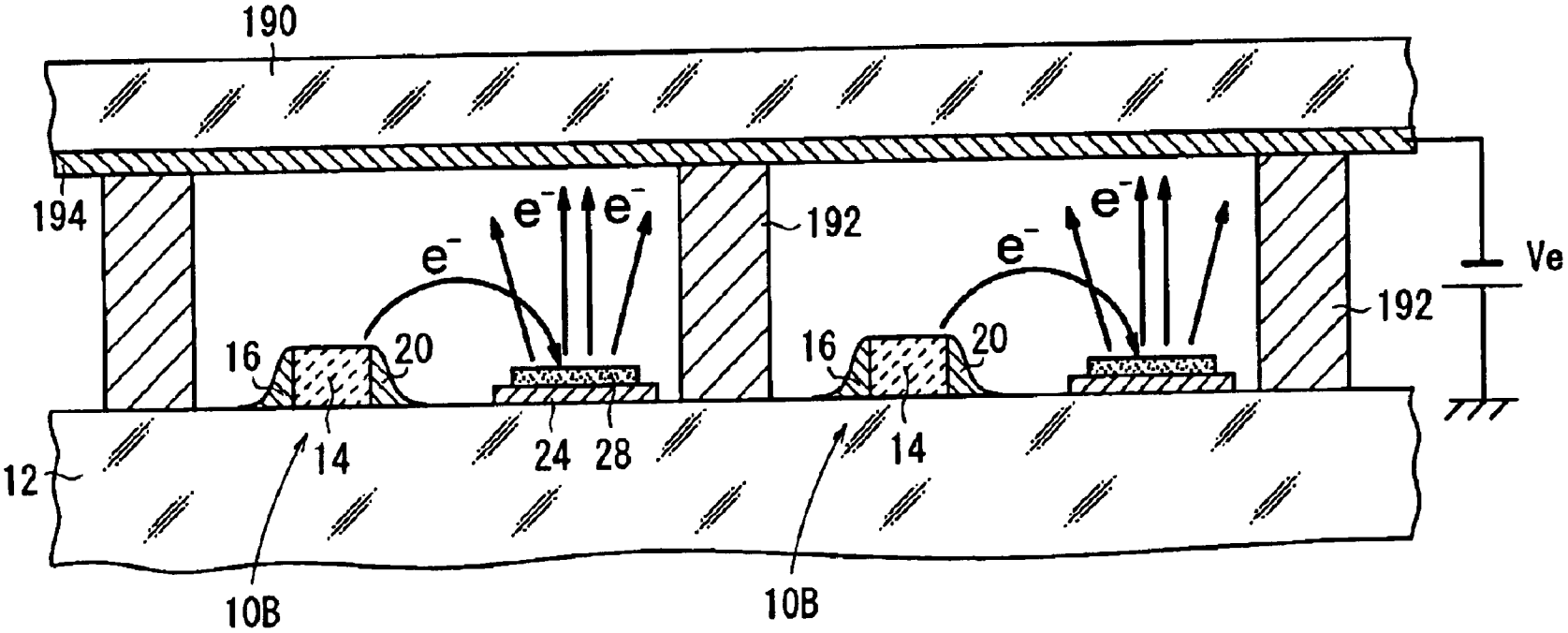
FIG. 11 is a view showing a preferred arrangement of display pixels constructed of the electron emitters according to the second specific example.

As shown in FIG. 11, it is preferable to form the collector electrode 24 on the upper surface of the substrate 12, and to form the fluorescent layer 28 on the upper surface of the collector electrode 24. With this arrangement, even when the spacer 192 is negatively charged, the electric field distribution for directing the electrons emitted from the electron emitters 10B toward the collector electrode 24 is essentially not changed. Therefore, the fluorescent layer 28 can accurately be excited with the electron beam, preventing a displayed image quality failure.

Inasmuch as the electrons are not required to fly to the display panel 190, there is no need to take into account the spreading of the distribution of emitted electrons. Consequently, the pitch of pixels can be reduced, and hence the image resolution can be increased.

In the arrangement shown in FIG. 11, some of the electrons emitted from the electron emitters 10B may not be directed toward the collector electrode 24, but toward the display panel 190. Therefore, it is preferable to position a control electrode 194 on the reverse side of the display panel 190, and to apply a negative voltage Ve to the control electrode 194. The applied negative voltage Ve is effective to direct the electrons emitted from the electron emitters 10B efficiently toward the collector electrode 24 over the substrate 12 for thereby increasing the contribution of the emitted electrons to the excitation of the fluorescent layer.

Three modifications of the electron emitter 10B according to the second specific example will be described below with reference to FIGS. 12 through 16.

Figure 12:
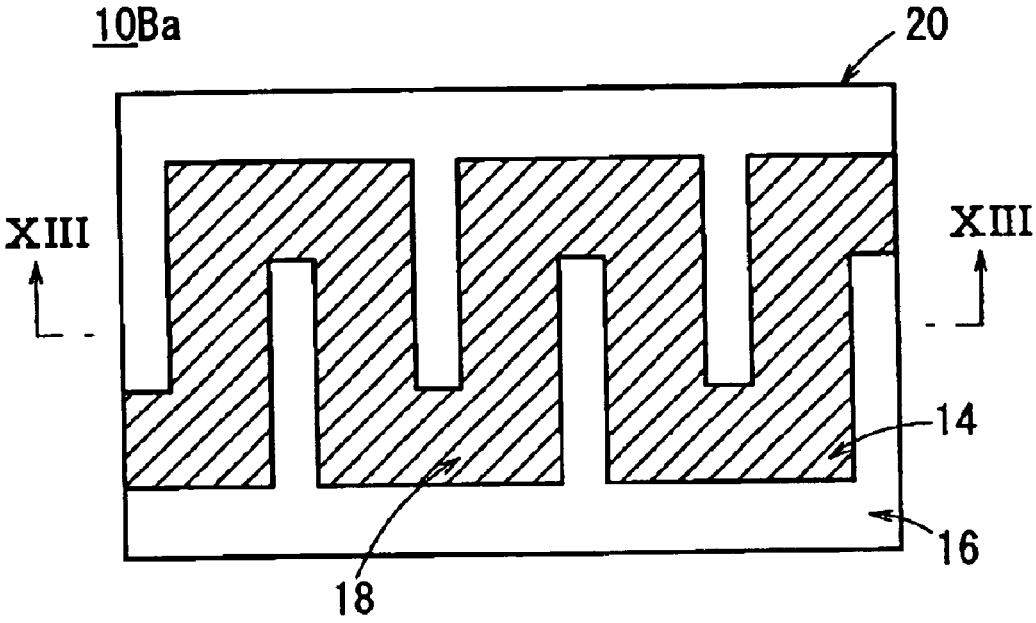
FIG. 12 is a plan view showing a first modification of the electron emitter according to the second specific example.
Figure 13:
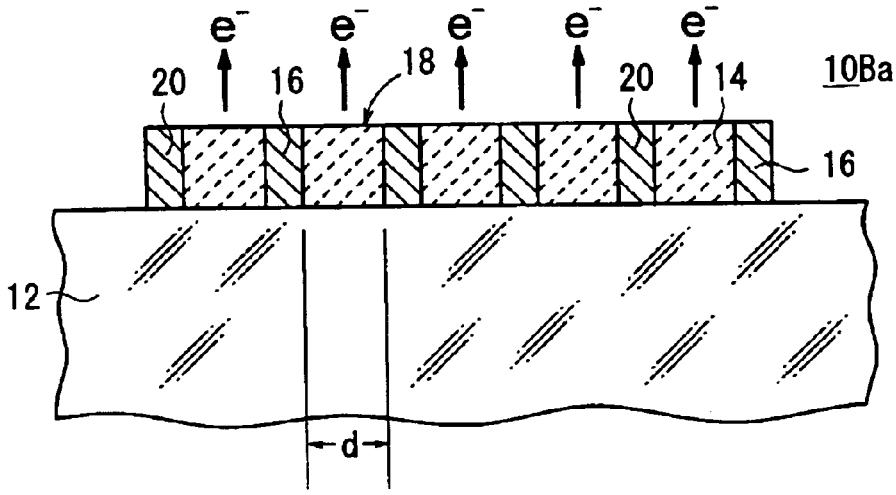
FIG. 13 is a cross-sectional view taken along a line XIII—XIII of FIG. 12.

An electron emitter 10Ba according to a first modification is based on the concept of the electron emitter 10B according to the second specific example. As shown in FIGS. 12 and 13, the electron emitter 10Ba has an emitter section 14 which has a tortuous shape as viewed in plan. The width d of the slit 18 between the cathode electrode 16 and the anode electrode 20 should preferably be in the range from 0.1 to 50 $\mu$m.

With the structure of the first modification, the electron emitter 10B is capable of emitting electrons efficiently because the area of contact between the cathode electrode 16 and the emitter section 14 and the area of contact between the emitter section 14 and the anode electrode 20 are increased.

Figure 14:
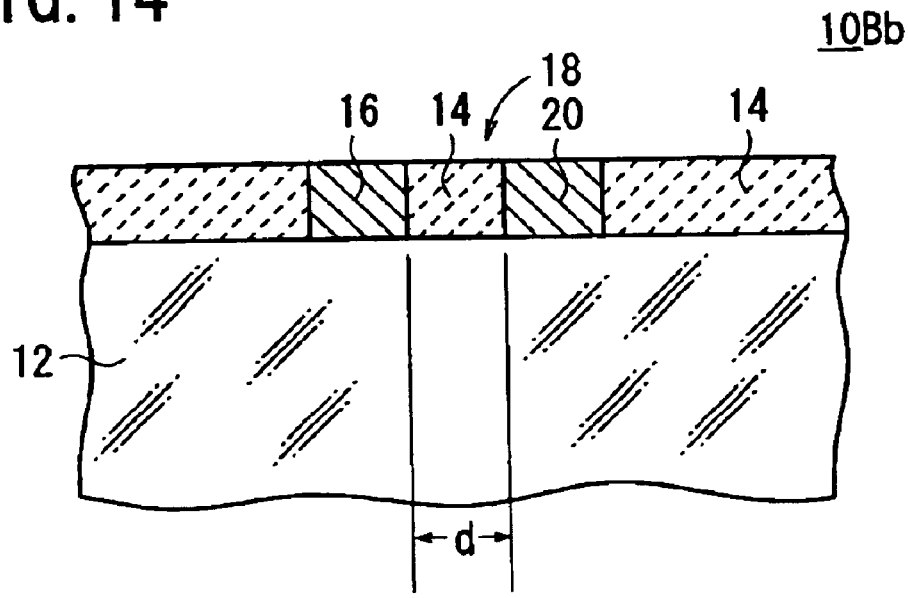
FIG. 14 is a cross-sectional view showing a second modification of the electron emitter according to the second specific example.
Figure 15:
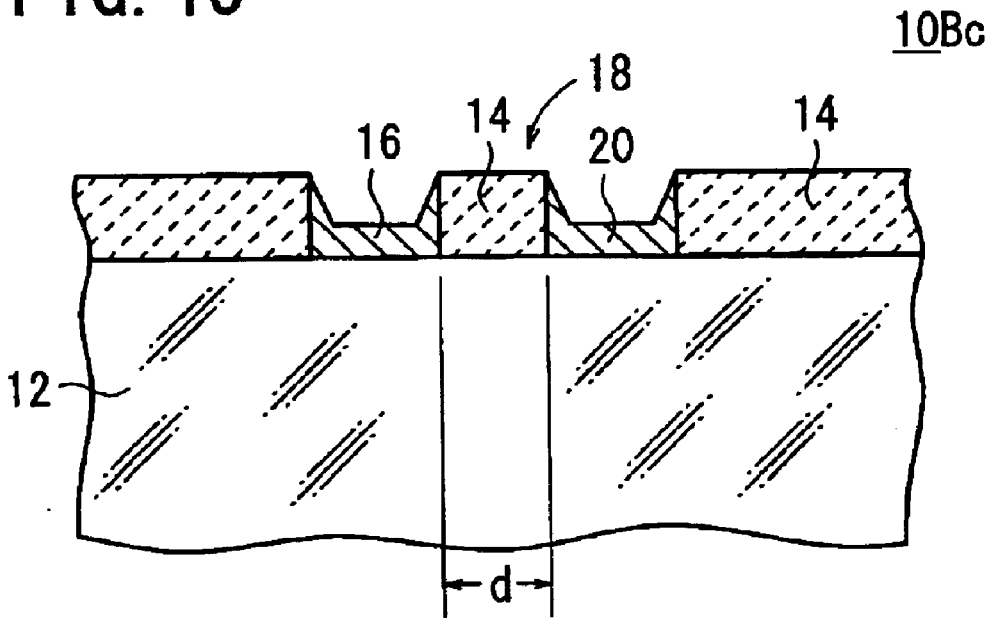
FIG. 15 is a cross-sectional view showing a third modification of the electron emitter according to the second specific example.
Figure 16:
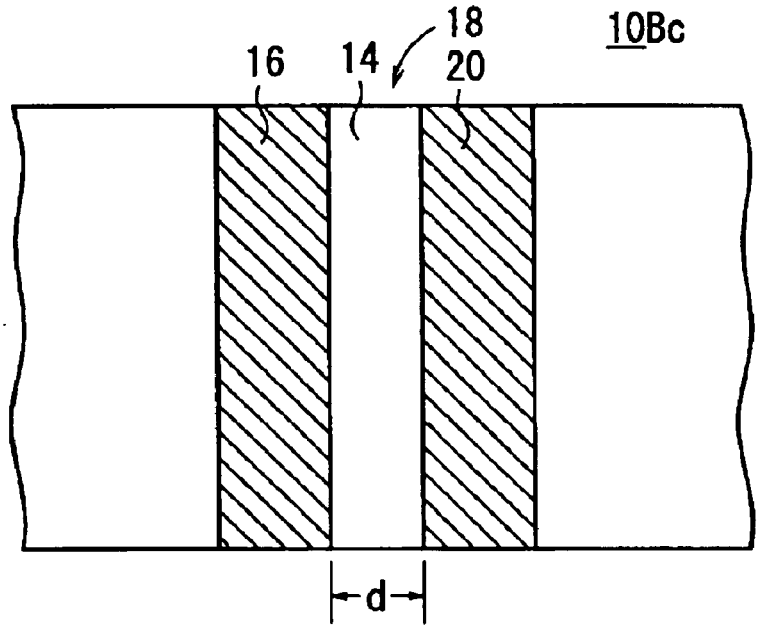
FIG. 16 is a plan view showing the third modification of the electron emitter according to the second specific example: example.

As shown in FIG. 14, an electron emitter 10Bb according to a second modification has an emitter section 14 of dielectric material formed on the substrate 12, and a cathode electrode 16 and an anode electrode 20 which are embedded in windows defined in the emitter section 14. The cross-sectional areas of the cathode electrode 16 and the anode electrode 20 are thus increased to reduce the resistance of the cathode electrode 16 and the anode electrode 20 for suppressing the generation of the Joule heat. That is, the cathode electrode 16 and the anode electrode 20 can be protected. The width of the portion of the emitter section 14 between the cathode electrode 16 and the anode electrode 20, i.e., the width d of the slit 18, should preferably be in the range from 0.1 to 50 $\mu$m.

According to the second modification, the thickness of the cathode electrode 16 and the anode electrode 20 is essentially the same as the thickness of the emitter section 14. However, the thickness of the cathode electrode 16 and the anode electrode 20 may be smaller than the thickness of the emitter section 14 as with an electron emitter 10Bc according to a third modification shown in FIGS. 15 and 16. According to the third modification, as with the second specific example shown in FIG. 7, the cathode electrode 16 and the anode electrode 20 are formed in contact with side walls of a portion of the emitter section 14 which is present at least in the slit 18.

According to the third modification, as with the first modification, since the cathode electrode 16 and the anode electrode 20 may be made of a reduced amount of metal, the cathode electrode 16 and the anode electrode 20 may be made of an expensive metal (e.g., platinum or gold) for improved characteristics.

An experimental example with respect to electron emission will be described below. In this experimental example, a single electron emitter is placed as a sample 10Bd (see FIG. 17) in a vacuum chamber 180 (the vacuum level=$4\times10^{-3}$ Pa), and, when a drive voltage Va shown in FIG. 18A is supplied to the cathode electrode 16, the waveforms of currents Ia, Ik, Ic flowing in respective parts of the electron emitter and the waveform of a voltage Vak between the cathode electrode 16 and the anode electrode 20 are measured. The measured waveforms are shown in FIGS. 18B through 18E.

Figure 17:
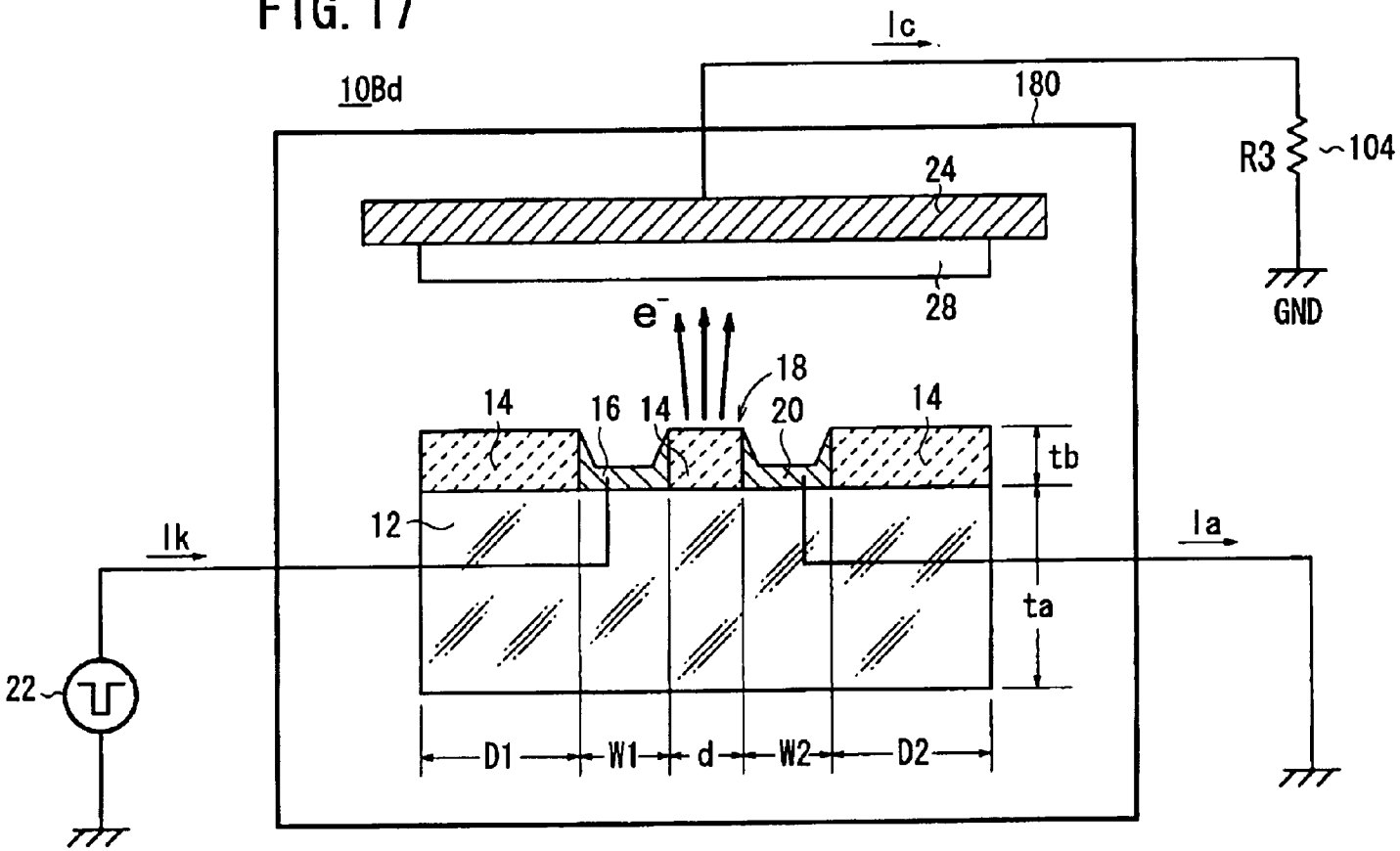
FIG. 17 is a view showing a sample used in an experimental example.
Figures 18A, 18B, 18C, 18D, 18E:
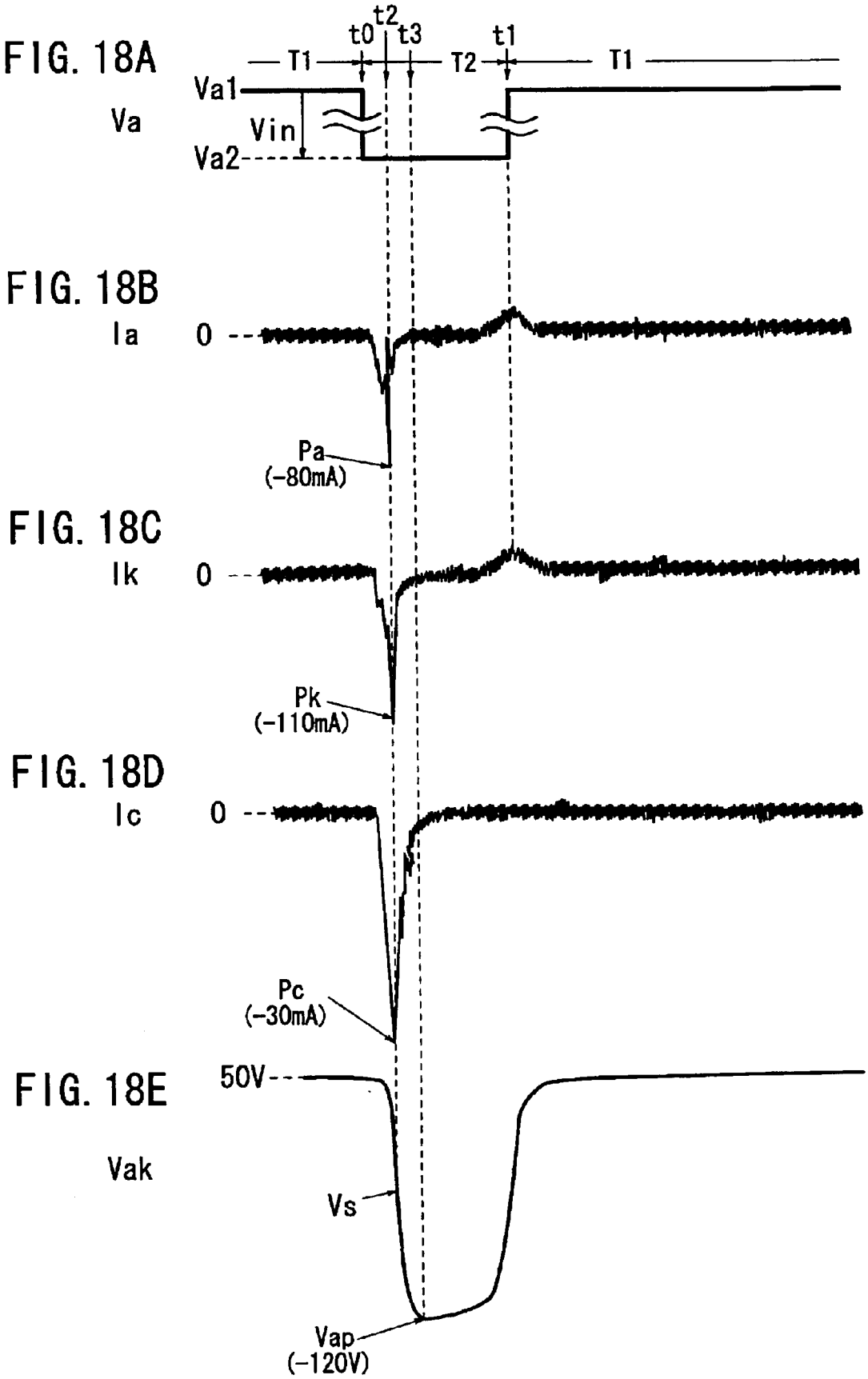
FIG. 18A is a waveform diagram showing a drive signal.
FIG. 18B is a waveform diagram showing a current flowing from an anode electrode to GND.
FIG. 18C is a waveform diagram showing a current flowing from a pulse generation source to a cathode electrode.
FIG. 18D is a waveform diagram showing a current flowing from a collector electrode to GND.
FIG. 18E is a waveform diagram showing a voltage applied between the cathode electrode and the anode electrode.

As shown in FIG. 17, the sample 10Bd has the same structure as the electron emitter 10Bc (see FIG. 15) according to the third modification. The sample 10Bb is dimensioned as follows: The substrate 12 has a thickness ta of 140 $\mu$m. The emitter section 14 has a thickness tb of 40 $\mu$m. The cathode electrode 16 has a width W1 of 40 $\mu$m. The anode electrode 20 has a width W2 of 40 $\mu$m. The slit 18 has a width d of 30 $\mu$m. The end of the cathode electrode 16 (which is opposite to the end thereof in the slit 18) is spaced from a near side end of the emitter section 14 by a distance D1 of 40 $\mu$m. The end of the anode electrode 20 (which is opposite to the end thereof in the slit 18) is spaced from a near side end of the emitter section 14 by a distance D2 of 40 $\mu$m.

Both the cathode electrode 16 and the anode electrode 20 are made of gold (Au), and the emitter section 14 is made of PZT (lead zirconate titanate).

As shown in FIG. 18A, the drive voltage Va has a first voltage Va1 of 50 V in the preparatory period T1. The drive voltage Va changes from the preparatory period T1 to the electron emission period T2 at a time t0. The drive voltage Va has a second voltage Va2 of −120 V in the electron emission period T2. The drive voltage Va changes to the preparatory period T1 at a time t1.

FIG. 18B shows the measured waveform of the current Ia flowing from the anode electrode 20 to GND. The current Ia has a peak Pa at a time t2 which is about 1 μsec. later than the time t0 of the negative-going edge of the drive voltage Va. The peak Pa has a value of about −80 mA.

FIG. 18C shows the measured waveform of the current Ik flowing from the pulse generation source 22 into the cathode electrode 16. The current Ik has a peak Pk at the time t2 which is about 1 μsec. later than the time t0 as with the current Ia. The peak Pk has a value of about −110 mA.

FIG. 18D shows the measured waveform of the current Ic flowing from the collector electrode 24 to GND. The current Ic has a peak Pc at the time t2 which is about 1 μsec. later than the time t0 as with the currents Ia, Ik. The peak Pc has a value of about −30 mA.

FIG. 18E shows the measured waveform of the voltage Vak between the cathode electrode 16 and the anode electrode 20. The voltage Vak has a peak Vap at a time t3 which is about 2 μsec. later than the time t0 of the negative-going edge of the drive voltage Va. The peak Vap has a value of about −120 V.

In this experimental example, the amplitude Vin of the drive voltage Va has a value of about 170 V at the maximum for the purpose of reliably emitting electrons. According to the measured waveforms, electrons are emitted at the time t2 which is about 1 μsec. prior to the time t3 when the peak Vap of the applied voltage Va occurs, and the voltage Vak has a value Vs of about −77 V at the time t2. The electron emission efficiency (Ic/Ik) at this time is 27%.

This indicates that the level of the amplitude Vin of the applied voltage Va which is actually required to emit electrons is not as high as 170V. In the example, electrons are emitted at the time when the voltage Vak between the cathode electrode 16 and the anode electrode 20 is about −77V. The applied voltage Va can be lowered to emit electrons.

The drive voltage Va may be lowered by optimizing the electron emitter 10 itself and also optimizing drive circuits therefor. The following description is aimed at optimization of drive circuits based on the present experimental example.

Drive circuits for the electron emitter 10 according to the present embodiment will be described below. For emitting primary electrons around the electric field concentration point A (see FIG. 1) in the cathode electrode 16 by applying the voltage Va between the cathode electrode 16 and the anode electrode 20, it is necessary to apply a sharp voltage change to the drive electrode 16. Thus, the electron emitter 10 can be driven stably.

Figure 19A:
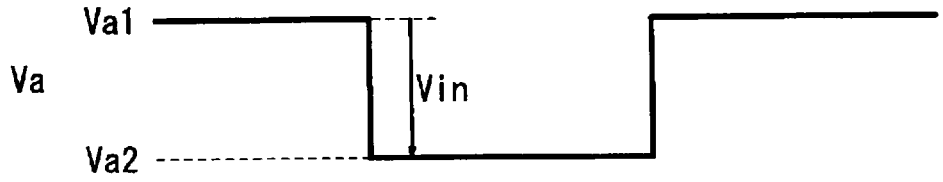
FIG. 19A is a waveform diagram showing a drive signal outputted from a pulse generation source.
Figure 19B:
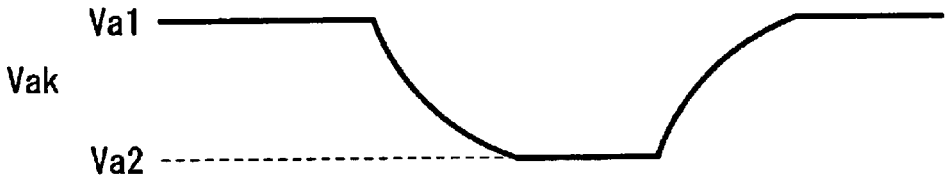
FIG. 19B is a waveform diagram showing a voltage applied to an electron emitter.

Usually, even when the drive voltage Va outputted from the pulse generation source 22 has a rectangular waveform as shown in FIG. 19A, the voltage Vak between the cathode electrode 16 and the anode electrode 20 is of a gradual nature as a whole, as shown in FIG. 19B, due to the CR time constant based on the electrostatic capacitance C and other resistive component between the cathode electrode 16 and the anode electrode 20.

Of the waveform of the voltage Vak, the voltage waveform immediately after the positive-going edge or negative-going edge of the drive voltage Va is relatively steep. However, the voltage level that rises or falls steeply is low, and the subsequent voltage waveform until the voltage level reaches 95%, for example, of a prescribed voltage (the amplitude Vin of the drive voltage Va) is gradual. An attempt may be made to obtain an apparent steep voltage change over a required voltage level by increasing the amplitude Vin of the drive voltage Va.

According to the above process, if the electron emitter 10 is regarded as a type of capacitor, then since the voltage Vak between the cathode electrode 16 and the anode electrode 20 is increased, electrons are emitted by a high-speed charging with a large current. However, a subsequent application of a high voltage causes an excessive current to flow, tending to damage the cathode electrode 16 owing to the Joule heat generated thereby and positive ions impinging upon the cathode electrode 16.

According to the present embodiment, drive circuits according to various specific examples shown below are employed to reduce the size and cost of the electron emitter, lower the electron emission voltage, and minimize damage to the cathode electrode 16 (and the anode electrode 20) for a longer service life thereof.

The electron emitter 10 (including various specific examples and modifications thereof) is applicable to drive circuits according to various specific examples described below. The electron emitter 10 is represented by a parallel circuit of a capacitor C and a resistor R in FIG. 20 and the subsequent figures.

Figure 20:
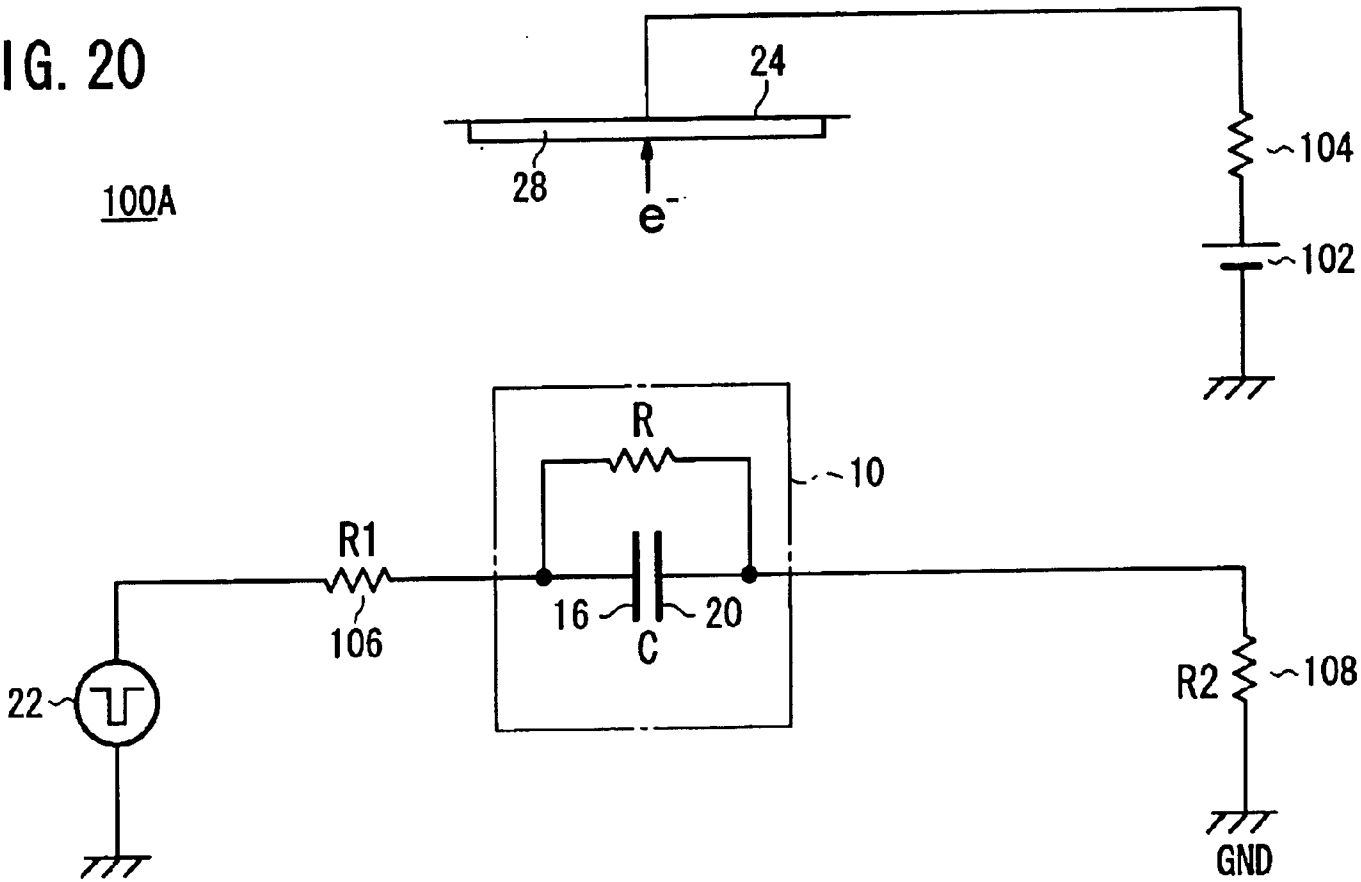
FIG. 20 is a circuit diagram showing a drive circuit according to a first specific example.

As shown in FIG. 20, a drive circuit 100A according to a first specific example has a resistor 106 (resistance R1) connected between the cathode electrode 16 and the pulse generation source 22, and a resistor 108 (resistance R2) connected between the anode electrode 20 and a common potential generation source (GND in this example). Thus, the resistor 106 and the resistor 108 are serially connected to the electron emitter 10.

Figure 21:
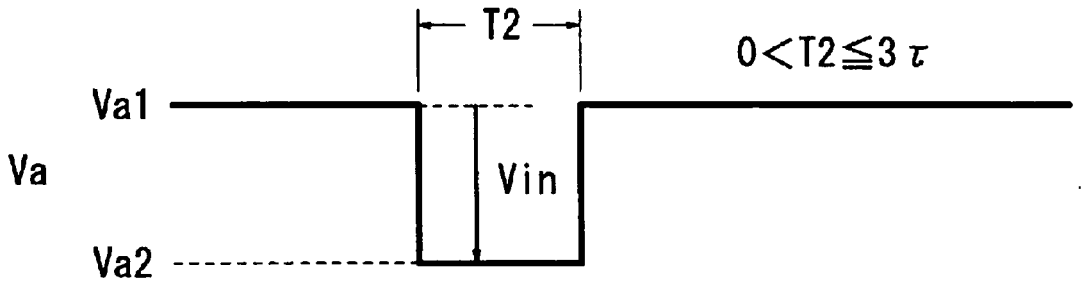
FIG. 21 is a waveform diagram showing a drive signal outputted from a pulse generation source in the drive circuit according to the first specific example.

As shown in FIG. 21, the electron emission period T2 of the drive voltage Va is in a range $0<T2\leqq 3\tau$ where $\tau$ represents a time constant determined by the electrostatic capacitance C provided by the cathode electrode 16 and the anode electrode 20 and the resistors 106, 108.

The resistors 106, 108 are effective to suppress an excessive current flowing in the electron emitter 10. Since the electron emission period T2 is the period of a sharp voltage change which contributes to electron emission, a wasteful current supply is eliminated, resulting in a reduction of electric power consumption, and an emission of excessive electrons is suppressed, reducing damage to the cathode electrode 16, etc.

In the above example, both the resistors 106, 108 are connected. However, only the resistor 106 or only the resistor 108 may be connected.

Figure 22:
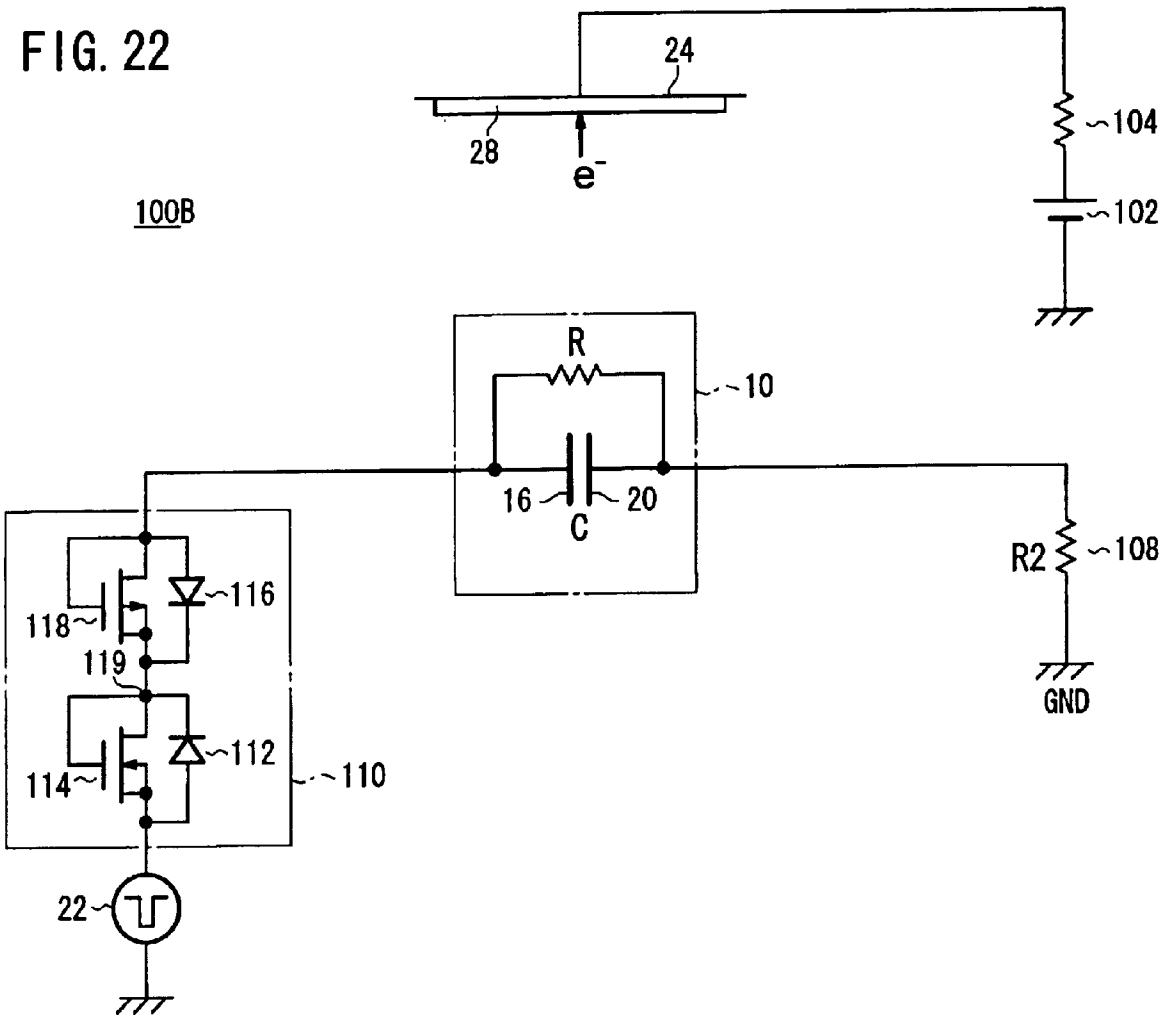
FIG. 22 is a circuit diagram showing a drive circuit according to a second specific example.

A drive circuit 100B according to a second specific example has essentially the same structure as the drive circuit 100A according to the first specific example, but differs therefrom in that the resistor 106 is replaced with a circuit 110 having nonlinear resistance characteristics, as shown in FIG. 22. The circuit 110 has an n-channel MOSFET (hereinafter referred to as n-MOSFET 114) including a drain-to-source protection diode 112 and a p-channel MOSFET (hereinafter referred to as p-MOSFET 118) including a drain-to-source protection diode 116, the n-MOSFET 114 and the p-MOSFET 118 being connected in series to each other. The drain of the n-MOSFET 114 and the source of the p-MOSFET 118 are connected to each other at a junction 119.

The n-MOSFET 114 has its gate connected to the junction 119, and the p-MOSFET 118 has its gate connected to the drain thereof.

Figure 23A:
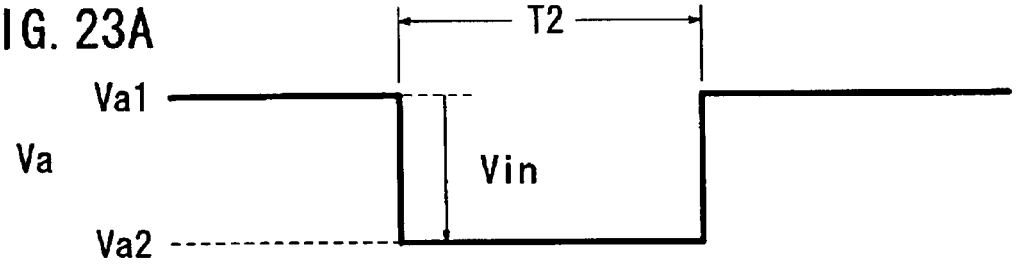
FIG. 23A is a waveform diagram showing a drive signal outputted from a pulse generation source in the drive circuit according to the second specific example.

When the source of the n-MOSFET 114 goes low at the start of the electron emission period T2, for example, as shown in FIG. 23A, a current flows from the electron emitter 10 through the diode 116 of the p-MOSFET 118 and the drain and source of the n-MOSFET 114.

Figure 23B:
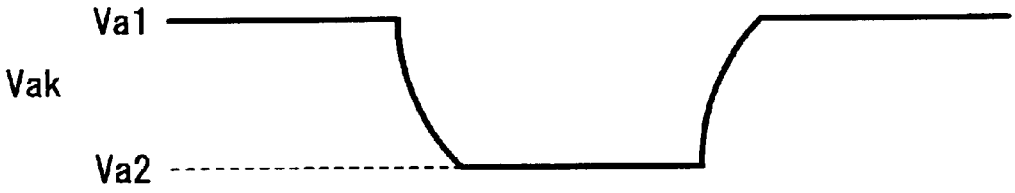
FIG. 23B is a waveform diagram showing a voltage applied to an electron emitter.

Because the current flows quickly due to the nonlinear resistance characteristics of the diode 116 and the n-MOSFET 114 at the start of the electron emission period T2, the voltage Vak between the cathode electrode 16 and the anode electrode 20 changes quickly from the first voltage Va1 to the second voltage Va2, as shown in FIG. 23B, thus providing a sharp voltage change. The cathode electrode 16, therefore, emits electrons efficiently.

When the source of the n-MOSFET 114 goes high at the end of the electron emission period T2, a current flows from the pulse generation source 22 through the diode 112 of the n-MOSFET 114 and the drain and source of the p-MOSFET 118.

At this time, the current from the pulse generation source 22 flows quickly due to the nonlinear resistance characteristics of the diode 112 and the p-MOSFET 118 at the end of the electron emission period T2, the voltage Vak between the cathode electrode 16 and the anode electrode 20 changes quickly from the second voltage Va2 to the first voltage Va1, as shown in FIG. 23B.

Consequently, the circuit 110 is effective to quickly change the voltage Vak between the cathode electrode 16 and the anode electrode 20, and also to suppress an excessive current. The electron emission period T2 can be set to a shorter period than a case in which the resistor 106 is used, and hence the preparatory period T1 (see FIG. 3) can also be set to a shorter period. When the electron emitter 10 is applied to a pixel of a display, for example, the frequency of a horizontal synchronizing signal can be increased, or a high resolution can be achieved.

Two modifications of the drive circuit 100B according to the second specific example will be described below with reference to FIGS. 24 and 25.

Figure 24:
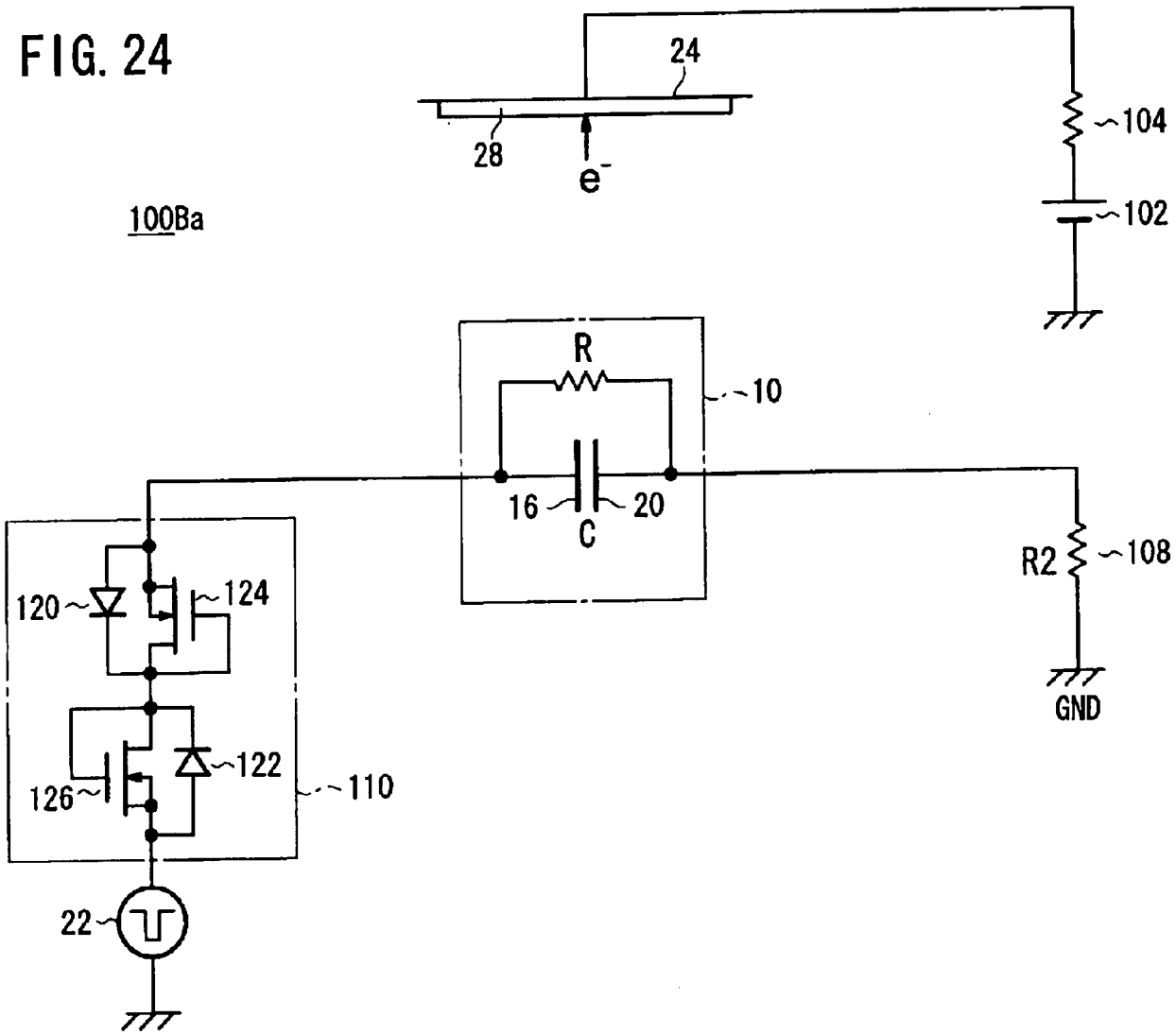
FIG. 24 is a circuit diagram showing a first modification of the drive circuit according to the second specific example.

A drive circuit 100Ba according to a first modification has essentially the same structure as the drive circuit 100B according to the second specific example, but differs therefrom in that, as shown in FIG. 24, the circuit 110 has two n-MOSFETs (first and second n-MOSFETs 124, 126) including respective drain-to-source protection diodes 120, 122 and connected in series to each other, with respective drains connected in common. The first and second n-MOSFETs 124, 126 have respective gates connected to the respective common drains.

According to the first modification, when the source of the second n-MOSFET 126 goes low at the start of the electron emission period T2, a current flows from the electron emitter 10 through the diode 120 of the first n-MOSFET 124 and the drain and source of the second n-MOSFET 126. When the source of the second n-MOSFET 126 goes high at the end of the electron emission period T2, a current flows from the pulse generation source 22 through the diode 122 of the second n-MOSFET 126 and the drain and source of the first n-MOSFET 124.

The circuit 110 shown in FIG. 24 is effective to quickly change the voltage Vak between the cathode electrode 16 and the anode electrode 20, and also to suppress an excessive current.

Figure 25:
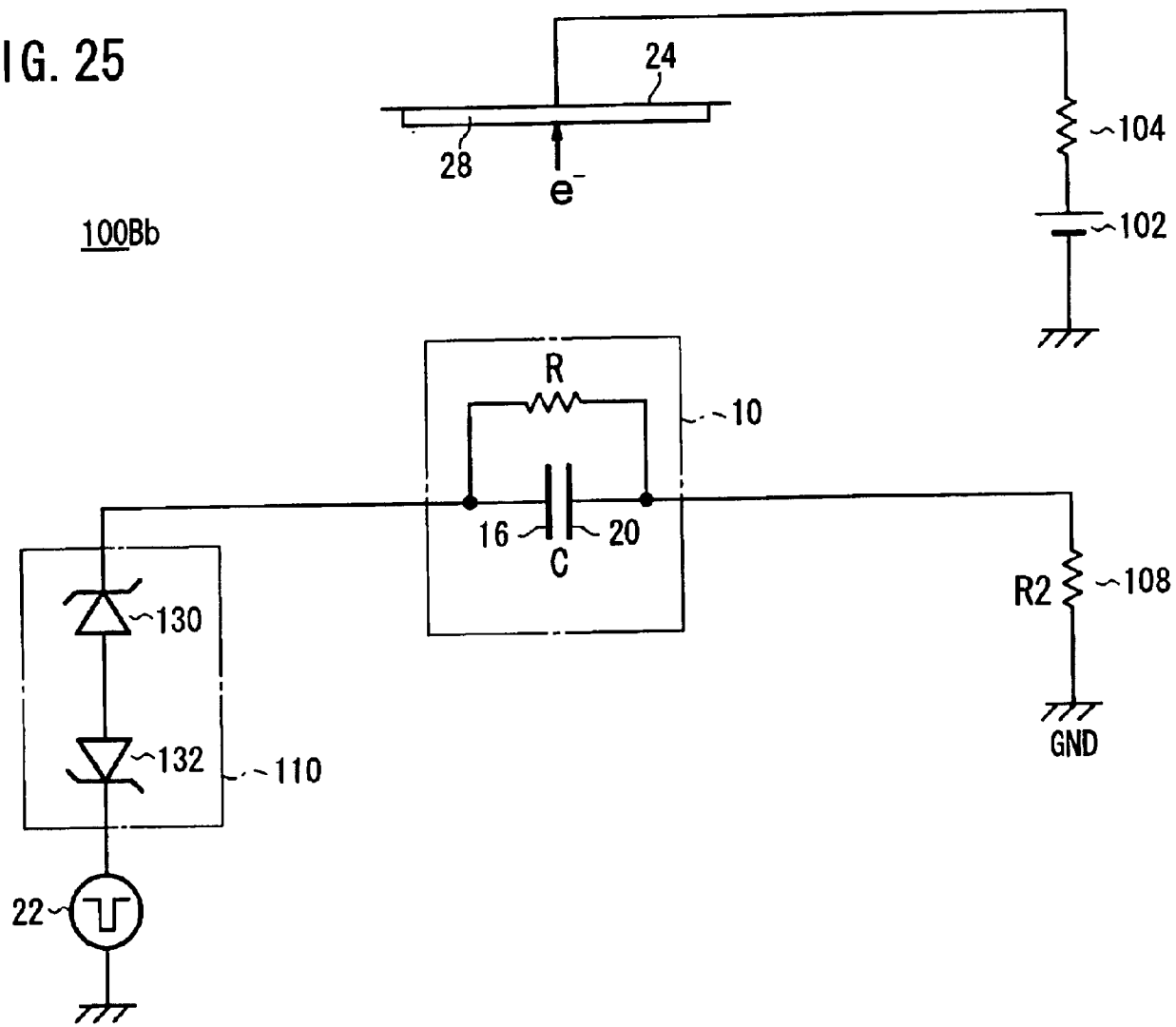
FIG. 25 is a circuit diagram showing a second modification of the drive circuit according to the second specific example.

A drive circuit 100Bb according to a second modification has essentially the same structure as the drive circuit 100B according to the second specific example, but differs therefrom in that, as shown in FIG. 25, the circuit 110 has two zener diodes (first and second zener diodes 130, 132) connected in series to each other, with respective anodes connected in common. The first zener diode 130 has a cathode connected to the electron emitter 10, the second zener diode 132 has a cathode connected to the pulse generator source 22. The first and second zener diodes 130, 132 have respective zener voltages set to 50 V, for example.

According to the second modification, when the cathode of the second zener diode 132 goes low at the start of the electron emission period T2, the first zener diode 130 is rendered conductive, allowing a current to flow from the electron emitter 10 through the first and second zener diodes 130, 132. At this time, the current flows quickly due to the nonlinear resistance characteristics of the second zener diode 132, so that the voltage Vak between the cathode electrode 16 and the anode electrode 20 changes sharply.

When the cathode of the second zener diode 132 goes high at the end of the electron emission period T2, the second zener diode 132 is rendered conductive, allowing a current to flow from the pulse generation source 22 through the first and second zener diodes 130, 132.

A drive circuit 100C according to a third specific example will be described below with reference to FIG. 26. The drive circuit 100C according to the third specific example has essentially the same structure as the drive circuit 100A according to the first specific example, but differs therefrom in that it has a switching element 140 connected in series to the electron emitter 10. The resistor 106 may be replaced with the circuit 110 shown in FIGS. 22, 24, or 25.

Figure 27A:
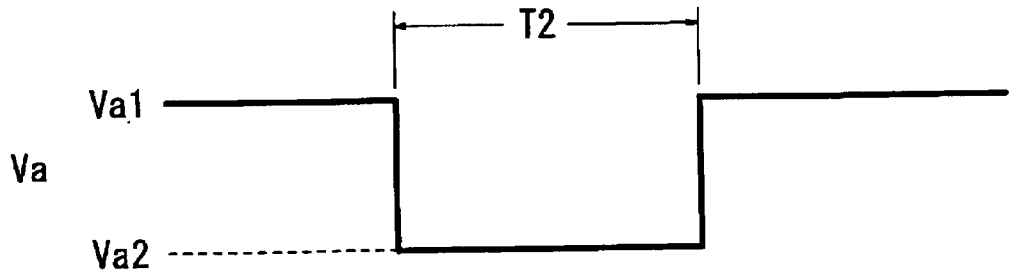
FIG. 27A is a waveform diagram showing a drive signal outputted from a pulse generation source in the drive circuit according to the third specific example.
Figure 27B:
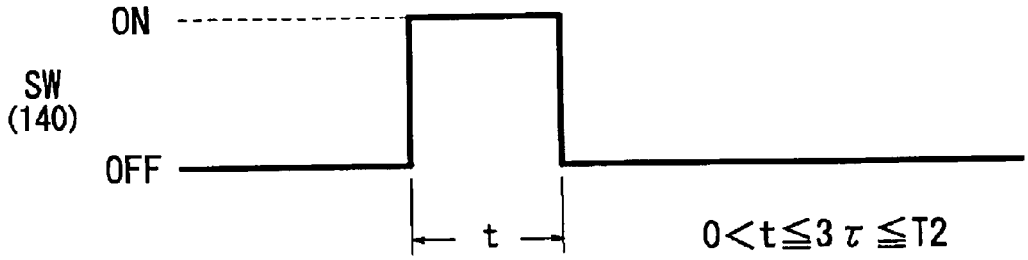
FIG. 27B is a timing chart showing an on-time of a switching element.

As shown in FIGS. 27A and 27B, if $\tau$ represents a time constant determined by the electrostatic capacitance C provided by the cathode electrode 16 and the anode electrode 20 and the resistors 106, 108, T2 the electron emission period, and t the on-time of the switching element 140, then the time constant $\tau$, the electron emission period T2, and the on-time t satisfy the relationship: $0<t\leqq 3\tau\leqq T2$.

In this case, since the switching element 140 is turned on in the period of a sharp voltage change which contributes to electron emission, a wasteful current supply is eliminated, resulting in a reduction of electric power consumption, and an emission of excessive electrons is suppressed.

If the resistor 106 is replaced with the circuit 110 shown in FIGS. 22, 24, or 25, then the on-time t and the electron emission period T2 can be made shorter.

Figure 26:
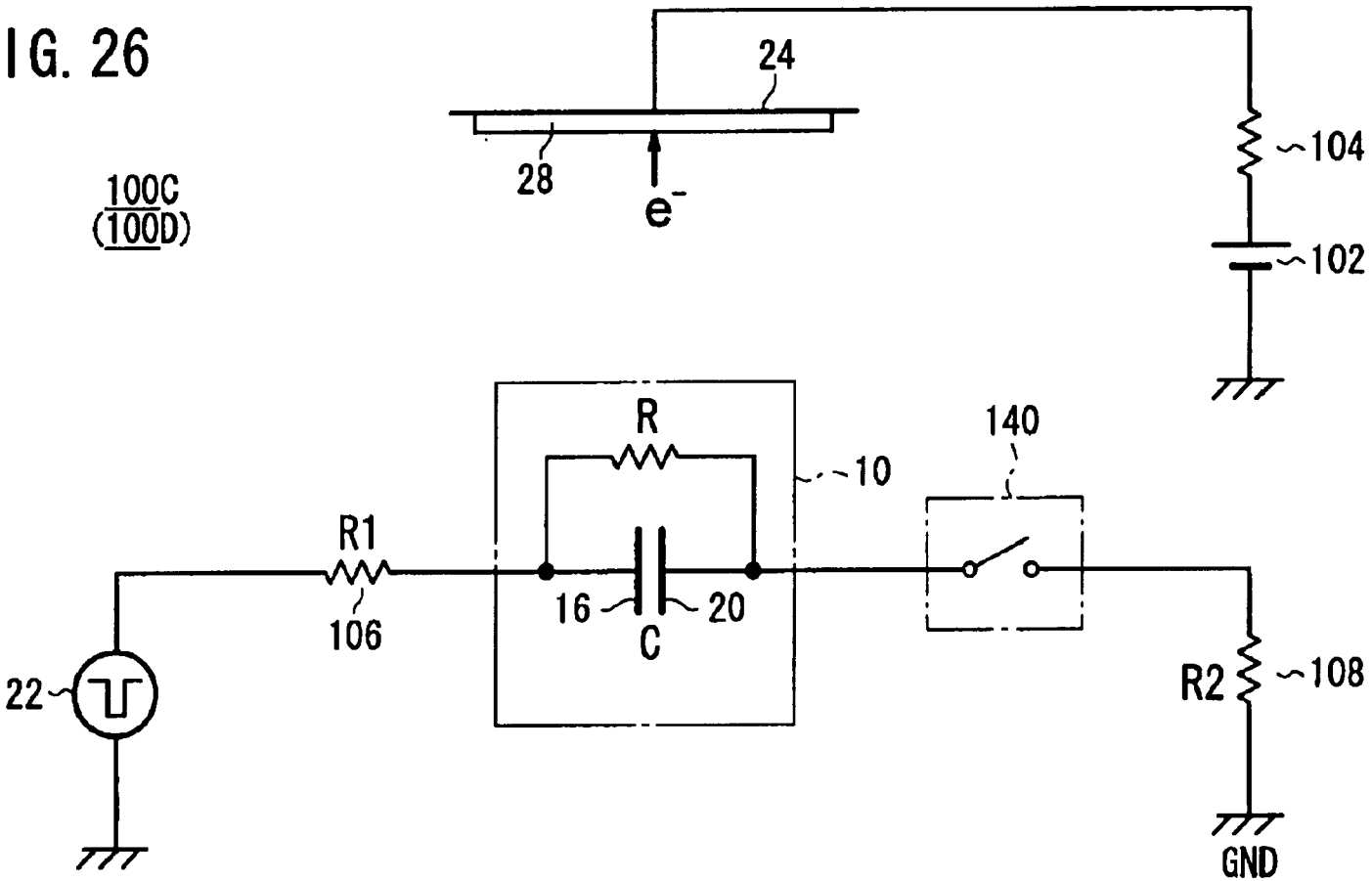
FIG. 26 is a circuit diagram showing a drive circuit according to a third specific example (and a drive circuit according to a fourth specific example)
Figure 28A:
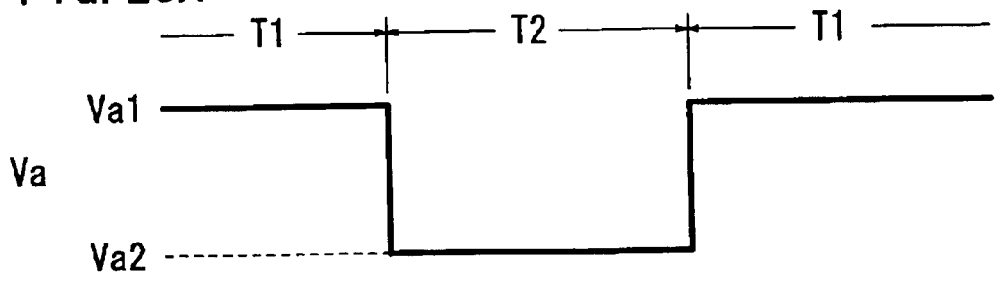
FIG. 28A is a waveform diagram showing a drive signal outputted from a pulse generation source in a drive circuit according to a fourth specific example.
Figure 28B:
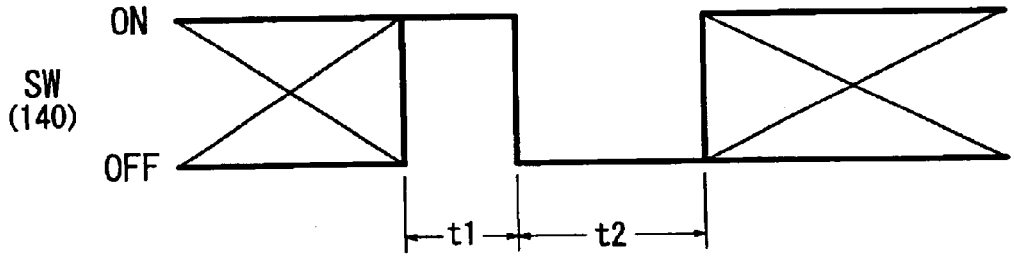
FIG. 28B is a timing chart showing an on-time and an off-time of a switching element.

As shown in FIG. 26, a drive circuit 100D according to a fourth specific example has essentially the same structure as the drive circuit 100C according to the third specific example, but differs therefrom in that, as shown in FIGS. 28A and 28B, if an on-time of the switching element 140 for emitting electrons is represented by t1, and a subsequent off-time of the switching element 140 for keeping electrons emitted and suppressing a current flowing into the cathode electrode is represented by t2, then these times are set in the range: $0<t1\leqq 3\tau<t2\leqq T2$. In the preparatory period T1, the switching element 140 is in an arbitrary state (on or off).

In the on-time t1 of the switching element 140, a sharp voltage change contributing to electron emission occurs, and in the off-time t2, the electron emission is kept and the current flowing into the cathode electrode 16 is suppressed. Therefore, a wasteful current supply is eliminated, resulting in a reduction of electric power consumption, and an emission of excessive electrons is suppressed.

Figure 29:
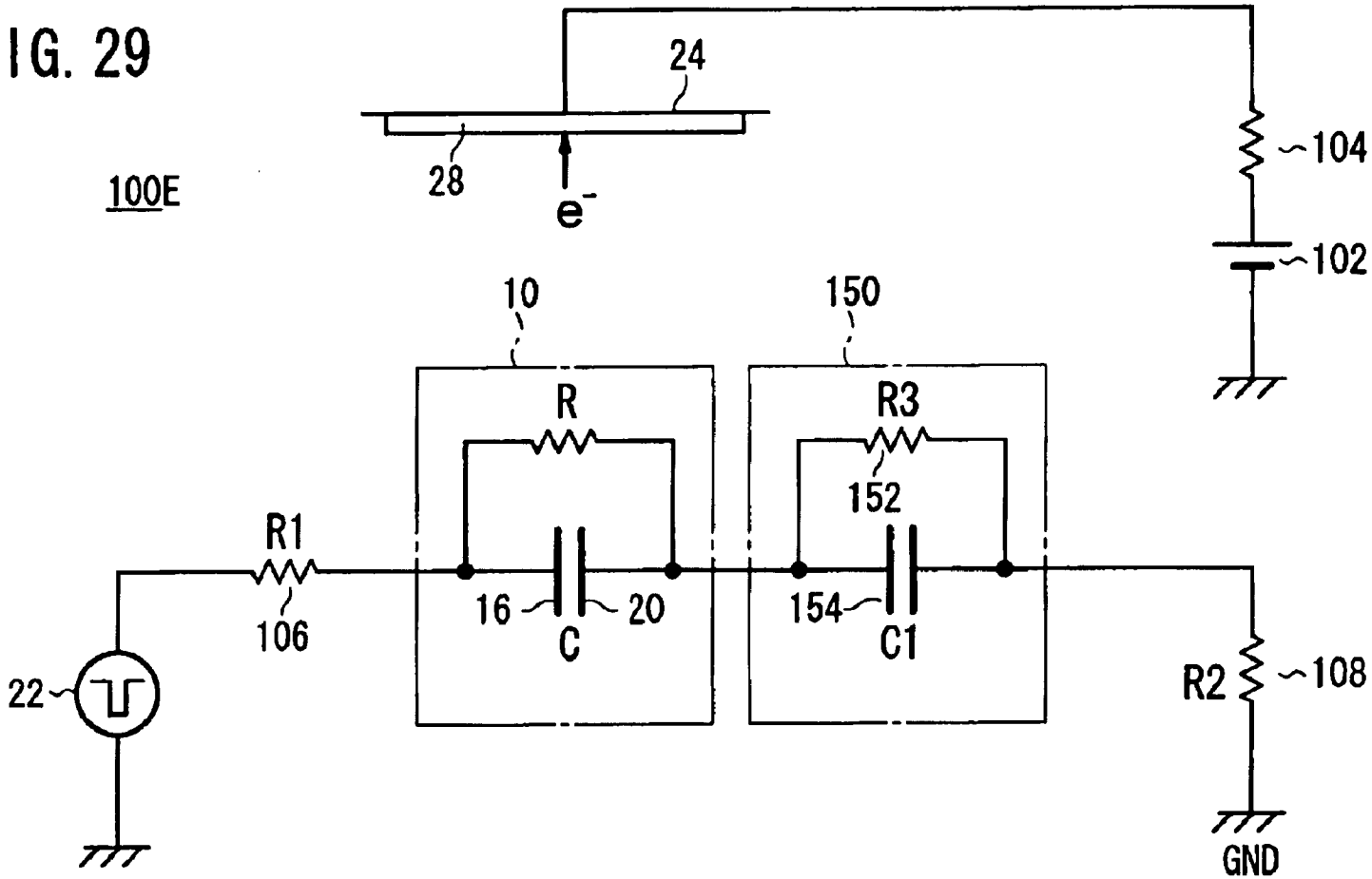
FIG. 29 is a circuit diagram showing a drive circuit according to a fifth specific example.

As shown in FIG. 29, a drive circuit 100E according to a fifth specific example has a single parallel circuit 150 connected in series to the electron emitter 10. The parallel circuit 150 comprises a resistor 152 and a capacitor 154 which are connected parallel to each other.

Figure 30A:
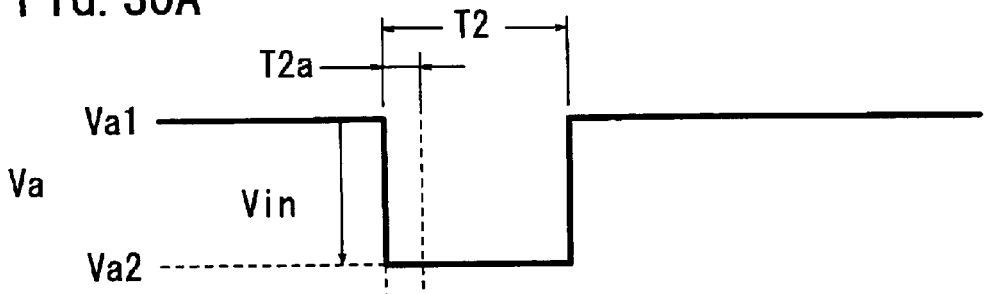
FIG. 30A is a waveform diagram showing a drive signal outputted from a pulse generation source in the drive circuit according to the fifth specific example.
Figure 30B:
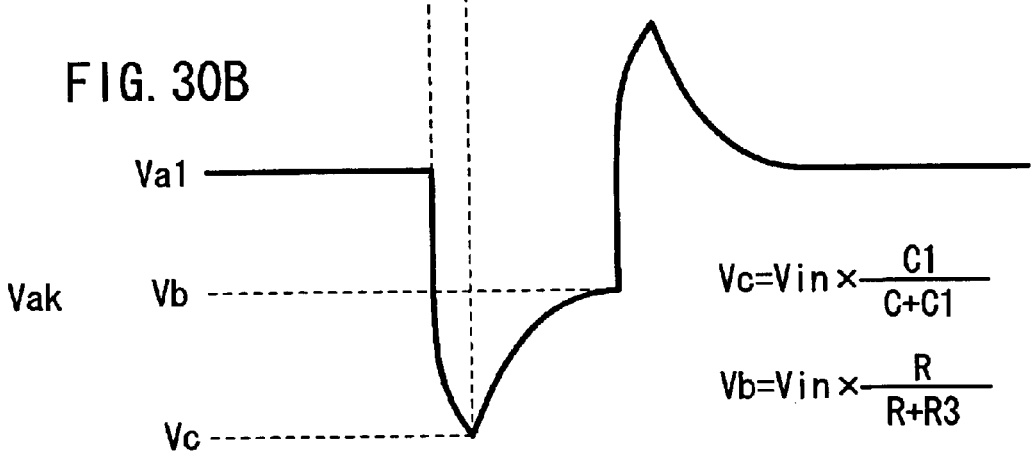
FIG. 30B is a waveform diagram showing a voltage applied between the cathode electrode and the anode electrode of an electron emitter.
Figure 31:
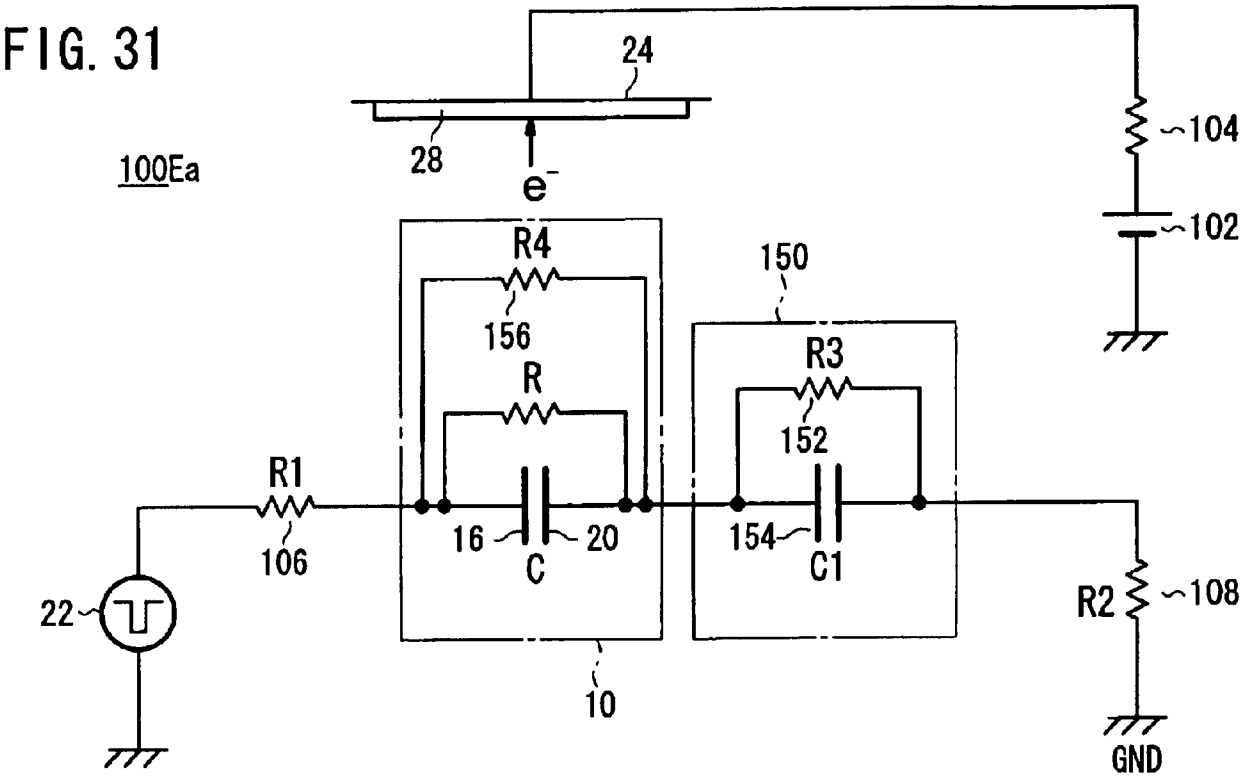
FIG. 31 is a circuit diagram showing a modification of the drive circuit according to the fifth specific example.

As shown in FIGS. 30A and 30B, of the electron emission period T2, an effective electron emission period T2a in which electrons are actually emitted is a period from the start of the electron emission period T2 to the time when the voltage Vak between the cathode electrode 16 and the anode electrode 20 reaches a divided level on the capacitor 154 of the amplitude Vin of the drive voltage Va.

Specifically, if it is assumed that the amplitude of the drive voltage Va in the pulse generation source 22 is represented by Vin (=Va1−Va2), the electrostatic capacitance between the cathode electrode 16 and the anode electrode 20 by C, the capacitance of the capacitor 154 of the parallel circuit 150 by C1, the resistance of the electron emitter 10 by R, and the resistance of the resistor 152 of the parallel circuit 150 by R3, then the effective electron emission period T2*a* is a time in which the level of the voltage Va applied between the cathode electrode 16 and the anode electrode 20 changes from a high level Vb to a low level Vc=Vin×{C1/(C+C1)} where the high level Vb=Vin×{R/(R+R3)}.

Immediately after elapse of the effective electron emission period T2a, the applied voltage Va changes quickly and then gradually toward the high level Vb, and finally reaches the high level Vb when the electron emission period T2 elapses.

Since the capacitor 154 of the parallel circuit 150 is connected in series to the electrostatic capacitance C formed by the cathode electrode 16 and the anode electrode 20 of the electron emitter 10, the overall capacitance becomes smaller than the electrostatic capacitance C formed by the cathode electrode 16 and the anode electrode 20, and the CR time constant becomes smaller accordingly. As a result, there is obtained a voltage change going quickly up to a voltage level (Vin×{C1/(C+C1)} which is required for emitting electrons as the voltage Vak between the cathode electrode 16 and the anode electrode 20, so that the electron emission voltage can be lowered.

Inasmuch as the absolute value of the applied voltage Va is reduced at the same time that the electron emission period T2 is finished, an excessive current is suppressed, reducing damage to the cathode electrode 16 and the anode electrode 20 for a longer service life thereof.

With the drive circuit 100E according to the fifth specific example, since the applied voltage Va reaches the level Vin×{R/(R+R3)} after elapse of the effective electron emission period T2a, it is preferable to bring the level Vin×{R/(R+R3)} closely to 0 if the dynamic range of the applied voltage Va is to be increased.

Ideally, the resistance R3 of the resistor 152 of the parallel circuit 150 may be set to infinity, but doing so tends to reduce the freedom with which to select the resistor 152. According to a solution, a drive circuit 100Ea according to a modification shown in FIG. 31 has a resistor 156 of a low resistance R4 connected parallel to the resistance (resistance R) of the electron emitter 10. Since the resistor 156 thus connected lowers the combined resistance of the electron emitter 10, the freedom with which to select the resistor 152 of the parallel circuit 150 can be increased.

Figure 32:
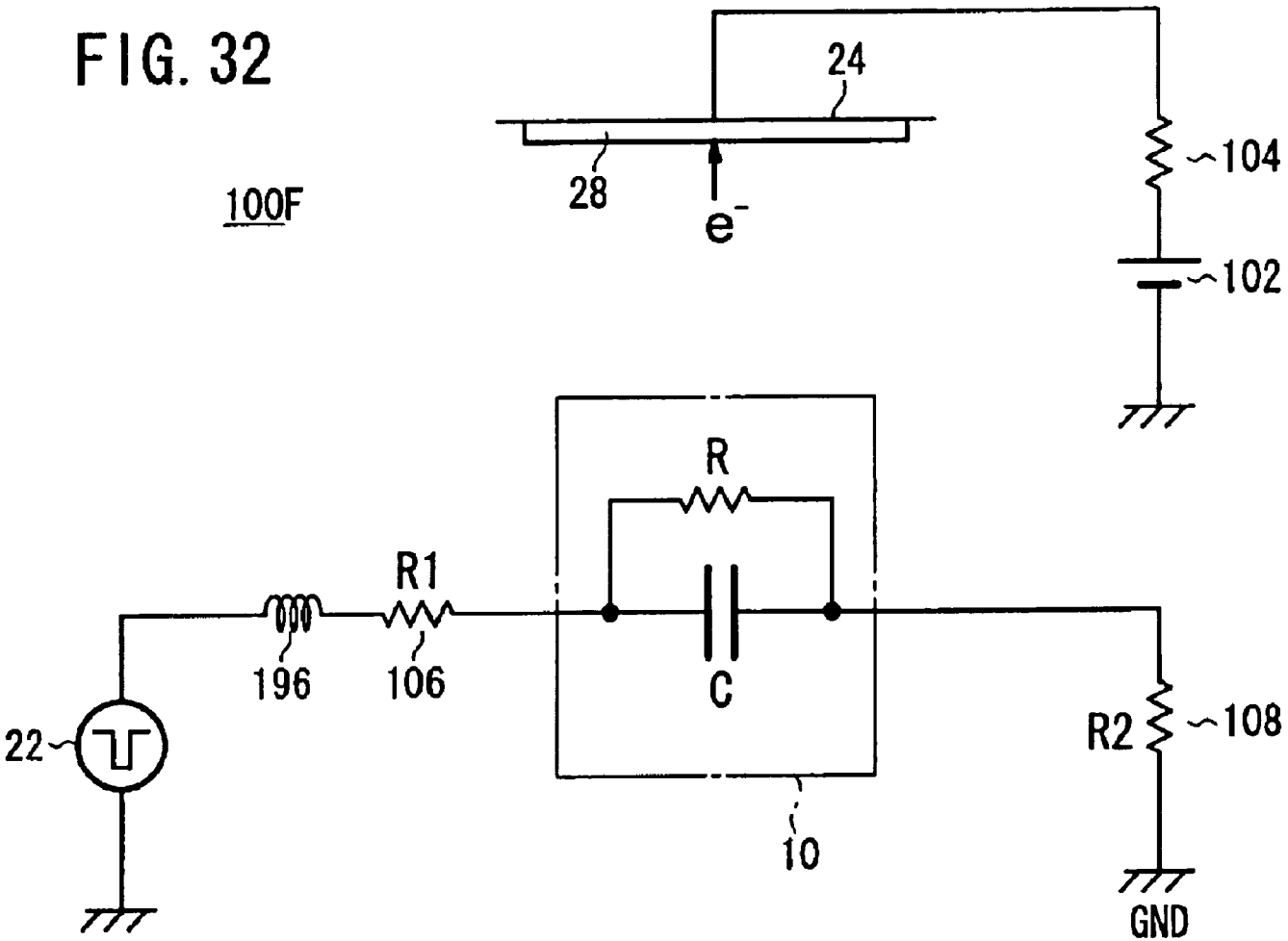
FIG. 32 is a circuit diagram showing a drive circuit according to a sixth specific example.

A drive circuit 100F according to a sixth specific example is of substantially the same structure as the drive circuit 100A according to the first specific example, but differs therefrom in that, as shown in FIG. 32, an inductor 196 is connected in series between the pulse generation source 22 and the resistor 106.

The inductor 196 thus connected is effective to reduce the time required until the voltage Vak between the cathode electrode 16 and the anode electrode 20 becomes a predetermined voltage (coercive voltage if the emitter section 14 is made of a piezoelectric material) from the time when the second voltage Va2 of the drive voltage Va starts to be applied. Furthermore, a quick rise or fall time can be achieved without lowering the resistances of the resistors 106, 108. The inductor 196 may be formed by partially making tortuous the pattern shape of a lead connected to the cathode electrode 16.

Figure 33:
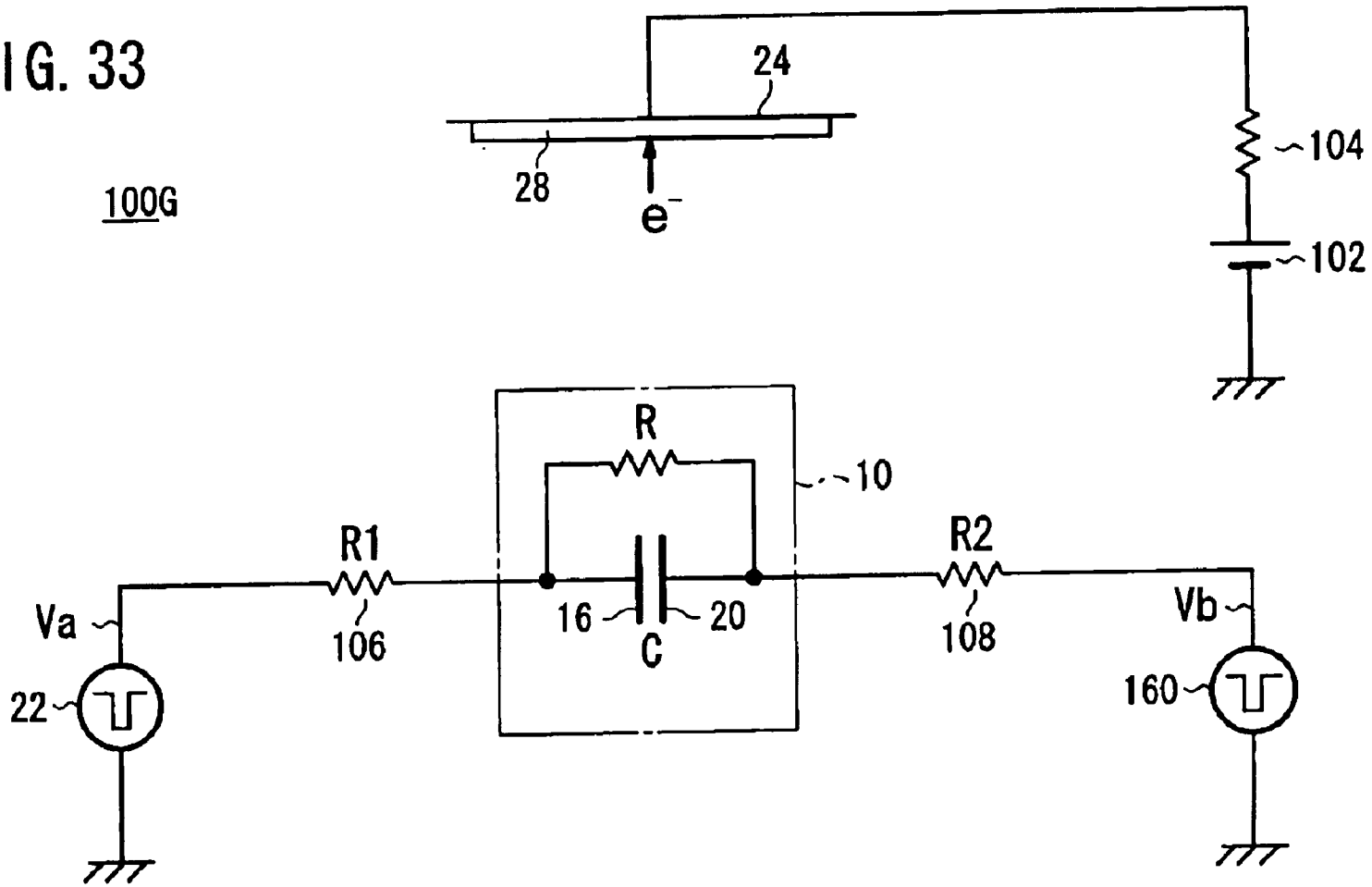
FIG. 33 is a circuit diagram showing a drive circuit according to a seventh specific example.

A drive circuit 100G according to a seventh specific example has essentially the same structure as the drive circuit 100A according to the first specific example, but differs therefrom in that, as shown in FIG. 33, a pulse generation circuit 160 is connected to the drive circuit 10G. The pulse generation circuit 160 applies a voltage Vb for changing the polarity of the anode electrode 20 into the polarity which is different from the polarity of the potential of the cathode electrode 16 at least in the electron emission period T2.

Figure 34A:
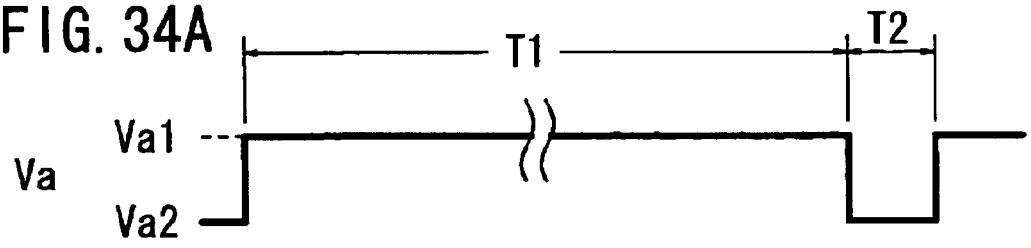
FIG. 34A is a waveform diagram showing a drive signal outputted from a pulse generation source in the drive circuit according to the sixth specific example.
Figure 34B:
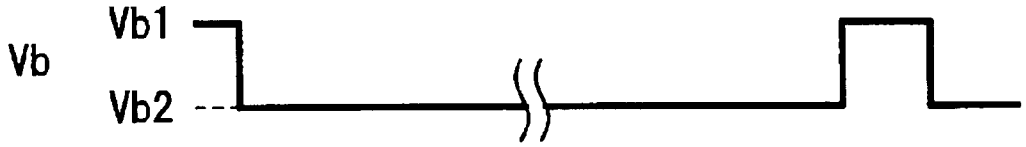
FIG. 34B is a waveform diagram showing a drive signal outputted from a pulse generation circuit.

Specifically, as shown in FIGS. 34A and 34B, in the preparatory period T1, the pulse generation source 22 outputs a voltage Va1 of 30 V, and the pulse generation circuit 160 outputs a voltage Vb2 of −100V. In the electron emission period T2, the pulse generation source 22 outputs a voltage Va2 of −100 V, and the pulse generation circuit 160 outputs a voltage Vb1 of 30 V.

If the anode electrode 20 is under a constant potential and the cathode electrode 16 is supplied with the drive voltage Va, then the dynamic range of the voltage Va applied between the cathode electrode 16 and the anode electrode 20 is determined by the withstand voltage of the pulse generation source 22.

However, the pulse generation circuit 160 is effective to increase the dynamic range of the voltage Va applied between the cathode electrode 16 and the anode electrode 20 to a withstand voltage which is the sum of the withstand voltage of the pulse generation source 22 and the withstand voltage of the pulse generation circuit 160. In the example shown in FIGS. 34A and 34B, the amplitude Vin of the drive voltage Va in the electron emission period T2 is 260 V.

This means that, if the amplitude Vin of the drive voltage Va in the electron emission period T2 is 130 V, then a circuit having a withstand voltage which is one-half (65 V in this example) the above normal withstand voltage may be used as the pulse generation source 22 and the pulse generation circuit 160. Therefore, the drive circuit 100G can be made smaller in size and lower in cost.

Figure 35:
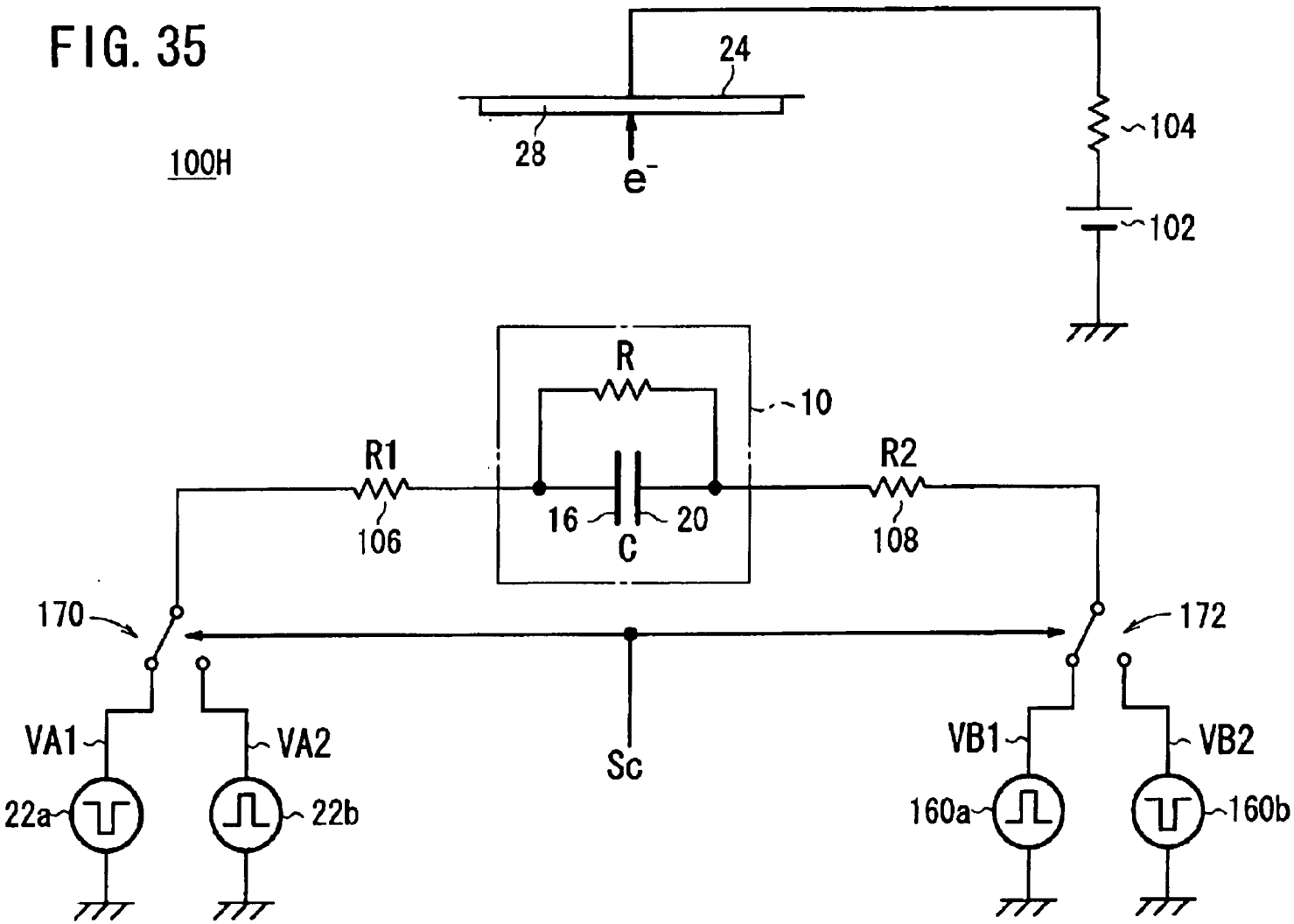
FIG. 35 is a circuit diagram showing a drive circuit according to an eighth specific example.

A drive circuit 100H according to an eighth specific example will be described below with reference to FIG. 35. The drive circuit 100H according to the eighth specific example has essentially the same structure as the drive circuit 100G according to the seventh specific example, but differs therefrom in that it has two pulse generation sources (first and second pulse generation sources 22*a*, 22*b*) for applying a drive voltage between the cathode electrode 16 and GND, a first switching circuit 170 for switching the pulse generation sources 22*a*, 22*b* based on a switching control signal Sc, two pulse generation circuits (first and second pulse generation circuits 160*a*, 160*b*) for applying a drive voltage between the anode electrode 20 and GND, and a second switching circuit 172 for switching the pulse generation circuits 160*a*, 160*b* based on the switching control signal Sc.

Figure 36A:
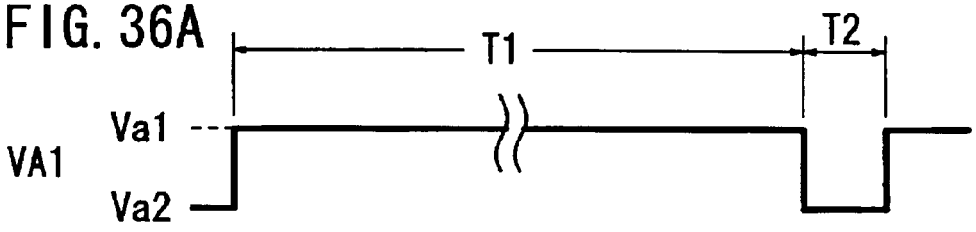
FIG. 36A is a waveform diagram showing a drive signal outputted from a second pulse generation source in the drive circuit according to the seventh specific example.

The first pulse generation source 22*a* outputs a drive voltage VA1 having such a voltage waveform that, as shown in FIG. 36A, a first voltage Va1 (e.g., 30 V) is applied between the cathode electrode 16 and GND in the preparatory period T1, and a second voltage Va2 (e.g., −100 V) is applied between the cathode electrode 16 and GND in the electron emission period T2.

Figure 36B:
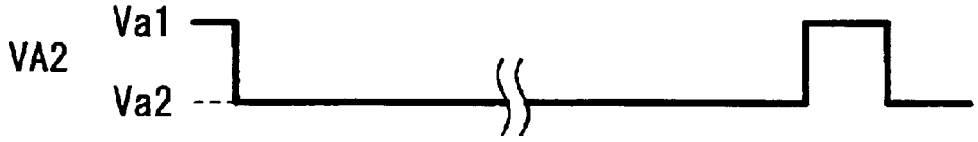
FIG. 36B is a waveform diagram showing a drive signal outputted from a second pulse generation source.

The second pulse generation source 22*b* outputs a drive voltage VA2 having such a voltage waveform that, as shown in FIG. 36B, a second voltage Va2 (e.g., −100 V) is applied between the cathode electrode 16 and GND in the preparatory period T1, and a first voltage Va1 (e.g., 30 V) is applied between the cathode electrode 16 and GND in the electron emission period T2.

Figure 36C:
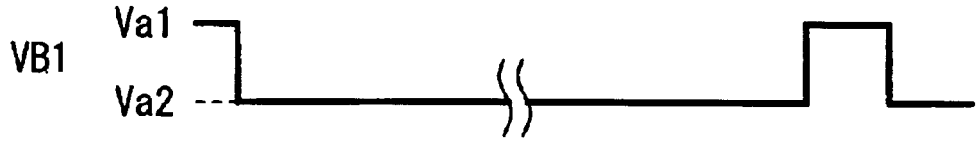
FIG. 36C is a waveform diagram showing a drive signal outputted from a first pulse generation circuit.

The first pulse generation circuit 160*a* outputs a drive voltage VB1 having such a voltage waveform that, as shown in FIG. 36C, a second voltage Va2 (e.g., −100 V) is applied between the anode electrode 20 and GND in the preparatory period T1, and a first voltage Va1 (e.g., 30 V) is applied between the anode electrode 20 and GND in the electron emission period T2.

Figure 36D:
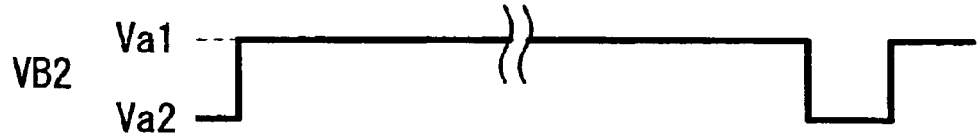
FIG. 36D is a waveform diagram showing a drive signal outputted from a second pulse generation circuit.

The second pulse generation circuit 160*b* outputs a drive voltage VB2 having such a voltage waveform that, as shown in FIG. 36D, a first voltage Va1 (e.g., 30 V) is applied between the anode electrode 20 and GND in the preparatory period T1, and a second voltage Va2 (e.g., 100 V) is applied between the anode electrode 20 and GND in the electron emission period T2.

The first and second switching circuits 170, 172 are ganged switching circuits for performing their switching operation based on one switching control signal Sc. The switching control signal Sc may comprise a command signal from a computer or a timer, for example. In the present specific example, the switching circuits 170, 172 are operated by voltage levels (a high level and a low level) of the switching control signal Sc.

When the first and second switching circuits 170, 172 select the first pulse generation source 22*a* and the first pulse generation circuits 160a, respectively, with the switching control signal Sc (e.g., a high voltage level), the first voltage Va1 is applied between the cathode electrode 16 and GND in the preparatory period T1, polarizing the emitter section 14, and the second voltage Va2 is applied between the cathode electrode 16 and GND in the electron emission period T2, reversing the polarization of the emitter section 14 thereby to enable the cathode electrode 16 to emit secondary electrons.

If the above sequence is regarded as one step, then the step is carried out once or a plurality of times while the switching control signal Sc is a high level, thus performing one cycle (first cycle) of operation.

Conversely, when the first and second switching circuits 170, 172 select the second pulse generation source 22*b* and the second pulse generation circuits 160*b*, respectively, with the switching control signal Sc (e.g., a low voltage level), the first voltage Va1 is applied between the anode electrode 20 and GND in the preparatory period T1, polarizing the emitter section 14, and the second voltage Va2 is applied between the anode electrode 20 and GND in the electron emission period T2, reversing the polarization of the emitter section 14 thereby to enable the anode electrode 20 to emit secondary electrons.

If the above sequence is regarded as one step, then the step is carried out once or a plurality of times while the switching control signal Sc is a low level, thus performing one cycle (second cycle) of operation.

Based on a command signal from a computer or a timer, the first and second switching circuits 170, 172 can switch between the first cycle and the second cycle in every step or every several steps as desired.

If the electron emitter 10 were energized in the first cycle only and plasma is generated, then positive ions generated by the plasma would impinge upon the cathode electrode 16, damaging the cathode electrode 16 only. Therefore, the durability of the electron emitter 10 would hinge only upon damage to the cathode electrode 16. If the electron emitter 10 were energized in the second cycle only, then the durability of the electron emitter 10 would hinge only upon damage to the anode electrode 20.

According to the present specific example, the first cycle and the second cycle are switched or selected as desired to distribute damage, which would otherwise be caused to one of the electrodes, to both the electrodes, with the result that the electrodes will have a longer service life.

The drive circuits 100A through 100H according to the first through eighth specific examples are arranged mainly for the purpose of suppressing excessive currents. If the electron emitter 10 is used as a pixel of a display, therefore, there may be a limitation posed on efforts to increase the luminance of the pixel.

Figure 37:
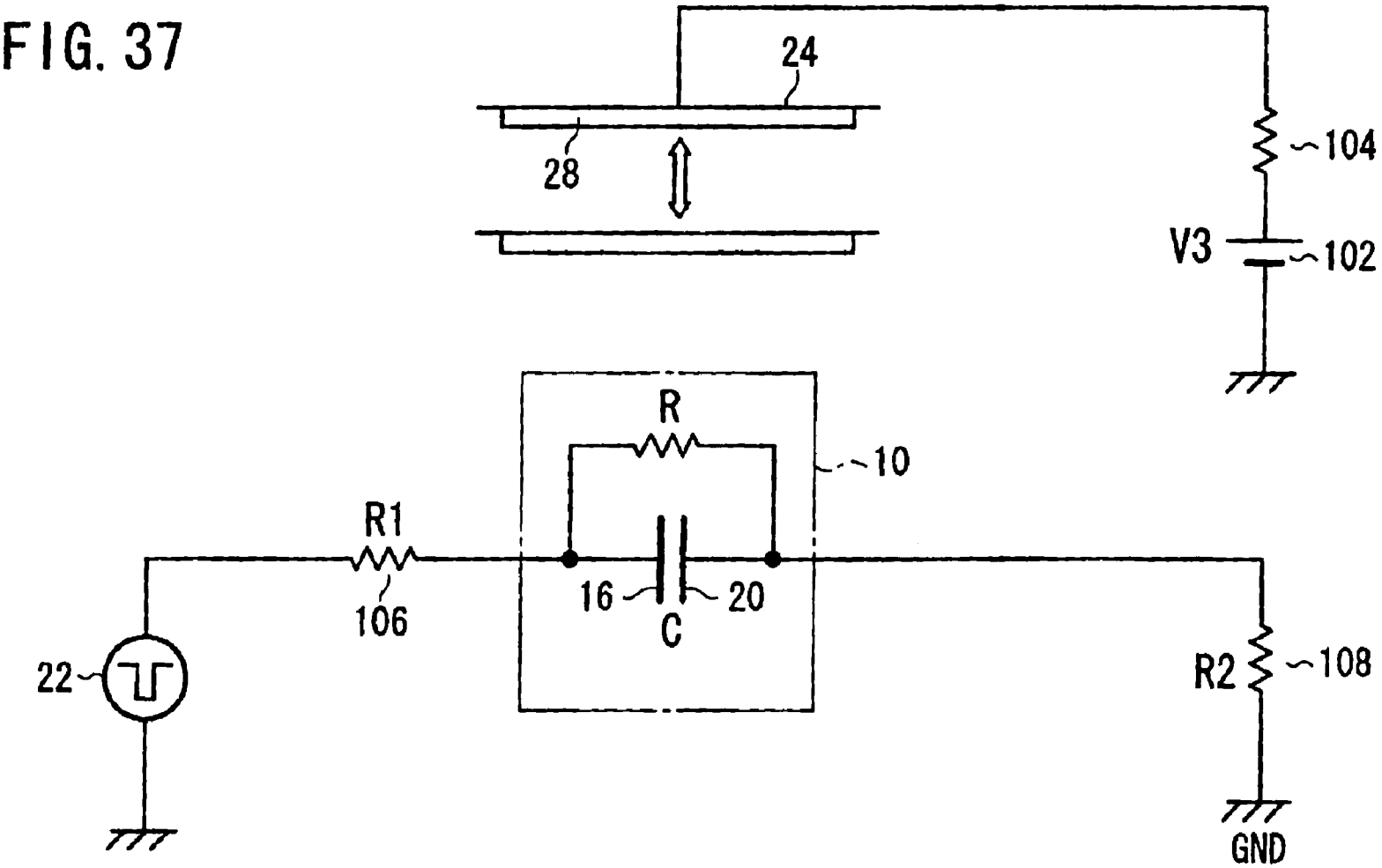
FIG. 37 is a diagram showing a preferred arrangement in which an electron emitter according to the present embodiment is applied to a pixel of a display.

According to one solution, as shown in FIG. 37, the collector electrode 24 associated with the electron emitter 10 whose luminance may possibly be limited is moved toward the slit 18 of the electron emitter 10, or the voltage V3 of the bias voltage source 102, which is applied to the collector electrode 24, is increased.

The electron emitter, the circuit for driving the electron emitter, and the method of driving the electron emitter according to the present invention are not limited to the above embodiments, but may be embodied in various arrangements without departing from the scope of the present invention.

What is claimed is:

1. An electron emitter comprising:

an emitter section made of a dielectric material;

a first electrode disposed in contact with said emitter section; and a second electrode disposed in contact with said emitter section and cooperating with said first electrode in providing a slit;

wherein electrons are emitted from said emitter section by reversing the polarization of at least a portion of said emitter section which is exposed through said slit under a drive voltage applied between said first electrode and said second electrode;

said slit having a width ranging from 0.1 $\mu$m to 50 $\mu$m.

2. An electron emitter according to claim 1, wherein the width of said slit ranges from 0.1 $\mu$m to 10 $\mu$m.

3. An electron emitter according to claim 1, wherein the width of said slit ranges from 0.1 $\mu$m to 1 $\mu$m.

4. An electron emitter according to claim 1, wherein said first electrode and said second electrode are formed on an upper surface of said emitter section, said slit comprising a gap.

5. An electron emitter according to claim 1, wherein said first electrode is formed in contact with one side surface of said emitter section, and said second electrode is formed in contact with another side surface of said emitter section, said emitter section being present in said slit.

6. An electron emitter according to claim 5, wherein said emitter section is formed in a tortuous pattern.

7. An electron emitter according to claim 1, wherein electrons are emitted from said emitter section near said first electrode which is lower in potential than said second electrode by reversing the polarization of at least the portion of said emitter section which is exposed through said slit under the drive voltage applied between said first electrode and said second electrode.

8. An electron emitter according to claim 1, wherein primary electrons are emitted from said first electrode by reversing the polarization of at least the portion of said emitter section which is exposed through said slit under the drive voltage applied between said first electrode and said second electrode and positioning the positive poles of dipole moments around said first electrode based on the reversed polarization, and secondary electrons are emitted from said emitter section when the primary electrons emitted from said first electrode impinge upon said emitter section.

9. An electron emitter according to claim 8, having a triple point in which said first electrode, the portion of said emitter section which is exposed through said slit, and a vacuum atmosphere are present, said primary electrons are emitted from a portion of said first electrode near said triple point, and the secondary electrons are emitted from said emitter section when the primary electrons emitted from said portion of the first electrode impinge upon said emitter section.

10. An electron emitter according to claim 1, further comprising:

a third electrode disposed over said emitter section at a position confronting at least said slit, said third electrode being coated with a fluorescent layer.

11. An electron emitter according to claim 5, wherein said emitter section is disposed on a substrate, said first electrode being disposed in contact with one side surface of said emitter section, said second electrode being disposed in contact with another side surface of said emitter section, said emitter section being present in said slit, said electron emitter further comprising:

a third electrode disposed over said substrate, said third electrode having an upper surface coated with a fluorescent layer.

12. An electron emitter according to claim 11, further comprising:

a fourth electrode disposed over said emitter section in confronting relation thereto, wherein a negative voltage is applied to said fourth electrode.

13. A drive circuit for energizing an electron emitter comprising:

an emitter section made of a dielectric material;

a first electrode disposed in contact with said emitter section; and a second electrode disposed in contact with said emitter section and cooperating with said first electrode in providing a slit;

wherein electrons are emitted from said emitter section by reversing the polarization of at least a portion of said emitter section which is exposed through said slit under a drive voltage applied between said first electrode and said second electrode;

said drive circuit comprising a capacitor connected in series to said electron emitter.

14. A drive circuit for energizing an electron emitter comprising:

an emitter section made of a dielectric material;

a first electrode disposed in contact with said emitter; and a second electrode disposed in contact with said emitter section and cooperating with said first electrode in providing a slit;

wherein electrons are emitted from said emitter section by reversing the polarization of at least a portion of said emitter section which is exposed through said slit under a drive voltage applied between said first electrode and said second electrode;

said drive circuit comprising a current-suppressing resistive element connected in series to said electron emitter.

15. A drive circuit according to claim 14, wherein said current-suppressing resistive element has nonlinear resistance characteristics.

16. A drive circuit according to claim 15, wherein said current-suppressing resistive element comprises a MOSFET device.

17. A drive circuit according to claim 14, further comprising:

an inductor connected in series to said electron emitter.

18. A drive circuit according to claim 13, wherein a step comprising a preparatory period in which a first voltage of such a level that said first electrode is higher in potential than said second electrode is applied between said first electrode and said second electrode to polarize said emitter section, and an electron emission period in which a second voltage of such a level that said first electrode is lower in potential than said second electrode is applied between said first electrode and said second electrode to polarize said emitter section to emit electrons therefrom, is repeated.

19. A drive circuit according to claim 18, wherein said second voltage is greater in absolute value than said first voltage.

20. A drive circuit according to claim 13, further comprising a switching circuit for switching between a first cycle and a second cycle, said first cycle including at least one step which comprises a preparatory period in which a first voltage of such a level that said first electrode is higher in potential than said second electrode is applied between said first electrode and said second electrode to polarize said emitter section, and an electron emission period in which a second voltage of such a level that said first electrode is lower in potential than said second electrode is applied between said first electrode and said second electrode to polarize said emitter section to emit electrons from said first electrode, said second cycle including at least one step which comprises a preparatory period in which said second voltage is applied between said first electrode and said second electrode to polarize said emitter section, and an electron emission period in which said first voltage is applied between said first electrode and said second electrode to polarize said emitter section to emit electrons from said second electrode.

21. A drive circuit according to claim 18, further comprising:

a pulse generation circuit for applying a voltage which turns the polarity of the potential of said second electrode into a polarity different from the polarity of the potential of said first electrode, to said second electrode in at least said electron emission period.

22. A drive circuit according to claim 18, wherein said preparatory period is longer than said electron emission period.

23. A drive circuit according to claim 18, wherein a time constant determined by an electrostatic capacitance and other resistive components between said first electrode and said second electrode is represented by $\tau$ and said electron emission period by T, and said time constant $\tau$ and said electron emission period T satisfy the following relationship:

$$0 \leqq T \leqq 3\tau.$$

24. A drive circuit according to claim 18, further comprising a switching element connected in series to said electron emitter, wherein a time constant determined by an electrostatic capacitance and other resistive components between said first electrode and said second electrode is represented by $\tau$, said electron emission period by T, and an on-time of said switching element by t, and said time constant $\tau$, said electron emission period T, and said on-time time t satisfy the following relationship:

$$0 \leqq t \leqq 3\tau \leqq T.$$

25. A circuit according to claim 24, wherein an on-time of said switching element for emitting electrons is represented by t1, and a subsequent off-time of said switching element for keeping electrons emitted and suppressing a current flowing into said first electrode by t2, and said time constant τ, said electron emission period T, said on-time t1, and said off-time t2 satisfy the following relationship:

$$0 \leqq t1 \leqq 3\tau < t2 \leqq T.$$

26. A drive circuit according to claim 18, further comprising at least one parallel circuit connected in series to said electron emitter, said parallel circuit comprising a resistor and a capacitor which are connected in parallel to each other, wherein said electron emission period includes an effective electron emission period from the start of application of said second voltage to the time when the voltage between said first electrode and said second electrode reaches a divided level on said capacitor of the amplitude of said drive voltage.

27. A method of driving an electron emitter having an emitter section made of a dielectric material, a first electrode formed in contact with said emitter section, and a second electrode formed in contact with said emitter section, with a slit defined between said first electrode and said second electrode, said method comprising repeating a step which comprises a preparatory period in which a first voltage is applied between said first electrode and said second electrode such that said first electrode has a potential higher than a potential of said second electrode to polarize said emitter section and an electron emission period in which a second voltage is applied between said first electrode and said second electrode such that said first electrode has a potential lower than a potential of said second electrode to reverse the polarization of said emitter section for emitting electrons.

28. An electron emitter according to claim 27, having a triple point in which said first electrode, the portion of said emitter section which is exposed through said slit, and a vacuum atmosphere are present, said primary electrons are emitted from a portion near said triple point, and the secondary electrons are emitted from said emitter section in said electron emission period.

29. A method according to claim 27, wherein said second voltage has an absolute value greater than said first voltage.

30. A method according to claim 27, further comprising switching between a first cycle and a second cycle, said first cycle including at least one step which comprises a preparatory period in which a first voltage is applied between said first electrode and said second electrode such that said first electrode has a potential higher than a potential of said second electrode to polarize said emitter section and an electron emission period in which a second voltage is applied between said first electrode and said second electrode such that said first electrode has a potential lower than a potential of said second electrode to reverse the polarization of said emitter section for emitting electrons from said first electrode, and said second cycle including at least one step which comprises a preparatory period in which said second voltage is applied between said first electrode and said second electrode to polarize said emitter section and an electron emission period in which said first voltage is applied between said first electrode and said second electrode to reverse the polarization of said emitter section for emitting electrons from said second electrode.

31. A method according to claim 27, further comprising applying a voltage to said second electrode at least in said electron emission period to change the potential of said second electrode to have a polarity different from a polarity of the potential of said first electrode.

32. A method according to claim 27, wherein said preparatory period is longer than said electron emission period.

33. A method according to claim 27, wherein a time constant determined by an electrostatic capacitance and other resistive components between said first electrode and said second electrode is represented by T and said electron emission period by T, and said time constant τ and said electron emission period T satisfy the following relationship:

$$0 \leqq T \leqq 3\tau.$$

34. A method according to claim 27, wherein a switching element is connected in series to said electron emitter, and a time constant determined by an electrostatic capacitance and other resistive components between said first electrode and said second electrode is represented by τ, said electron emission period by T, and an on-time of said switching element by t, and said time constant τ, said electron emission period T, and said on-time t satisfy the following relationship:

$$0 \leqq t \leqq 3\tau \leqq T.$$

35. A method according to claim 34, wherein an on-time of said switching element for emitting electrons is represented by t1, and a subsequent off-time of said switching element for keeping electrons emitted and suppressing a current flowing into said first electrode by t2, and said time constant τ, said electron emission period T, said on-time t1, and said off-time t2 satisfy the following relationship:

$$0 \leqq t1 \leqq 3\tau < t2 \leqq T.$$

36. A method according to claim 27, wherein at least one parallel circuit is connected in series to said electron emitter, said parallel circuit comprising a resistor and a capacitor which are connected in parallel to each other, wherein said electron emission period includes an effective electron emission period from the start of application of said second voltage to the time when the voltage between said first electrode and said second electrode reaches a divided level on said capacitor of the amplitude of said drive voltage.

* * * * *